US008800065B2

(12) United States Patent
Ikeda

(10) Patent No.: US 8,800,065 B2
(45) Date of Patent: Aug. 12, 2014

(54) HELMET AND METHOD OF REMOVING THE SAME

(75) Inventor: Yoshiyuki Ikeda, Ryugasaki (JP)

(73) Assignee: Shoei Co., Ltd., Tokyo (JP)

( * ) Notice: Subject to any disclaimer, the term of this patent is extended or adjusted under 35 U.S.C. 154(b) by 814 days.

(21) Appl. No.: 12/184,560

(22) Filed: Aug. 1, 2008

(65) Prior Publication Data

US 2009/0038054 A1 Feb. 12, 2009

(30) Foreign Application Priority Data

Aug. 7, 2007 (JP) ..... 2007-205711

(51) Int. Cl.

| | |
|---|---|
| ***A42B 3/00*** | (2006.01) |
| ***A42B 1/22*** | (2006.01) |
| ***A42B 3/32*** | (2006.01) |

(52) U.S. Cl.

CPC ..... *A42B 3/328* (2013.01)

USPC ..... 2/414; 2/6.1; 2/6.6; 2/411; 2/412; 2/413; 2/420; 2/421; 24/114.4; 24/107; 24/108; 24/662; 24/292

(58) Field of Classification Search

USPC ..... 2/410, 6.1, 6.6, 411, 412, 413, 414, 2/415, 416, 417, 420, 421, 422, 423, 424, 2/425, 427; D29/102, 103; 24/114.4, 24/144.05, 107, 108, 662, 292, 293, 294, 24/295, 297, 457, 581.11

See application file for complete search history.

(56) References Cited

U.S. PATENT DOCUMENTS

| | | | | |
|---|---|---|---|---|
| 3,127,615 | A | | 4/1964 | Aileo |
| 3,720,982 | A | * | 3/1973 | Myers et al. ..... 24/104 |
| 3,820,163 | A | | 6/1974 | Rappleyea |
| 4,290,150 | A | * | 9/1981 | Guerre-Berthelot ..... 2/421 |
| 4,404,690 | A | | 9/1983 | Farquharson |
| 4,475,273 | A | * | 10/1984 | Konno ..... 24/108 |
| 4,598,430 | A | * | 7/1986 | Nava ..... 2/410 |
| 4,796,309 | A | | 1/1989 | Nava |
| 4,916,759 | A | * | 4/1990 | Arai ..... 2/414 |
| 5,012,533 | A | | 5/1991 | Raffler |
| 5,088,129 | A | * | 2/1992 | Kamata ..... 2/411 |
| 5,272,773 | A | | 12/1993 | Kamata |
| 5,815,847 | A | | 10/1998 | Holden, Jr. |

(Continued)

FOREIGN PATENT DOCUMENTS

| | | |
|---|---|---|
| EP | 0 797 935 A1 | 10/1997 |
| EP | 0879 566 A2 | 11/1998 |

(Continued)

*Primary Examiner* — Amber Anderson
*Assistant Examiner* — Cameron A Carter
(74) *Attorney, Agent, or Firm* — Smith Gambrell & Russell LLP

(57) ABSTRACT

A helmet is provided which is to be worn on the head of a helmet wearer and can be removed from the head with a comparatively small force. Operation for removing the helmet, including preliminary operation for it, can be performed easily and quickly.

A recess-projection engaging mechanism to attach a blockish inside pad to a head protecting cap portion side includes an engaging pin on the inside pad side or head protecting cap portion side, and a notched engaging hole on the head protecting cap portion side or inside pad side. When pulling the inside pad outward from inside the head protecting cap portion at least partly, the engaging pin moves relative to outside the engaging hole through a notch of the engaging hole.

36 Claims, 13 Drawing Sheets

(56) References Cited

U.S. PATENT DOCUMENTS

| | | | | |
|---|---|---|---|---|
| 5,953,761 | A | 9/1999 | Jurga et al. | |
| 6,159,324 | A | 12/2000 | Watters et al. | |
| 6,185,753 | B1 | 2/2001 | Arai | |
| 6,202,223 | B1 | 3/2001 | Chartrand | |
| 6,253,386 | B1 | 7/2001 | Gafforio | |
| 6,256,797 | B1 * | 7/2001 | Nemoto et al. | 2/414 |
| 6,279,172 | B1 | 8/2001 | Epperson et al. | |
| 6,292,953 | B1 | 9/2001 | Beautz | |
| 6,308,343 | B1 * | 10/2001 | Arai | 2/414 |
| 6,421,841 | B2 * | 7/2002 | Ikeda | 2/414 |
| 6,499,147 | B2 | 12/2002 | Schiebl et al. | |
| 6,557,184 | B2 | 5/2003 | Gafforio | |
| 6,961,963 | B2 | 11/2005 | Rosie | |
| 7,207,071 | B2 | 4/2007 | Pierce | |
| 7,426,761 | B2 | 9/2008 | Tomcany et al. | |
| 7,854,023 | B2 * | 12/2010 | Ando | 2/414 |
| 2001/0034895 | A1 * | 11/2001 | Ikeda | 2/414 |
| 2002/0007508 | A1 | 1/2002 | Grepper et al. | |
| 2002/0035748 | A1 | 3/2002 | Racine | |
| 2002/0189005 | A1 | 12/2002 | Taniuchi | |
| 2003/0051289 | A1 | 3/2003 | Gafforio et al. | |
| 2003/0074722 | A1 | 4/2003 | Lee | |
| 2003/0088907 | A1 | 5/2003 | Gafforio et al. | |
| 2003/0182716 | A1 | 10/2003 | Wu | |
| 2003/0196255 | A1 | 10/2003 | Arai | |
| 2004/0034903 | A1 | 2/2004 | Blair | |
| 2006/0117467 | A1 | 6/2006 | Choi et al. | |
| 2006/0195973 | A1 * | 9/2006 | Ikeda | 2/410 |
| 2008/0289085 | A1 | 11/2008 | Bryant et al. | |
| 2009/0031483 | A1 | 2/2009 | Wallerberger | |
| 2009/0158506 | A1 | 6/2009 | Thompson et al. | |
| 2009/0260135 | A1 * | 10/2009 | Haselmayer | 2/423 |
| 2010/0095438 | A1 | 4/2010 | Moelker | |

FOREIGN PATENT DOCUMENTS

| | | | |
|---|---|---|---|
| EP | 1 293 138 | A1 | 3/2003 |
| EP | 1 854 368 | A2 | 11/2007 |
| EP | 2 022 358 | B1 | 7/2008 |
| JP | 62 69812 | | 3/1987 |
| JP | 09 119014 | | 5/1997 |
| JP | 11 247018 | | 9/1999 |
| JP | 2000 160424 | | 6/2000 |
| JP | 2001 115327 | | 4/2001 |
| JP | 2002 138320 | | 5/2002 |
| JP | 2003301316 | A * | 10/2003 |
| JP | 2005-54300 | A | 3/2005 |

* cited by examiner

HELMET AND METHOD OF REMOVING THE SAME

TECHNICAL FIELD

The present invention relates to a helmet comprising a head protecting cap portion with one or a plurality of blockish inside pads disposed therein, the helmet further comprising one or a plurality of connecting mechanisms to attach at least one of the blockish inside pads to the head protecting cap portion. The present invention also relates to a method of removing, from a head of a helmet wearer, a helmet comprising a head protecting cap portion with one or a plurality of blockish inside pads disposed therein, at least one of the blockish inside pads being attached to the head protecting cap portion in advance by one or a plurality of connecting mechanisms.

BACKGROUND OF THE INVENTION

A full-face-type helmet has been known. This helmet comprises a full-face-type head protecting cap portion worn by the rider of a motor cycle or the like on his/her head, a shield plate capable of opening/closing the window opening formed in the front surface of the head protecting cap portion to oppose the portion between the forehead and chin of the helmet wearer, and chin straps attached to the head protecting cap portion. According to such a full-face-type helmet, almost the entire head of the helmet wearer can be protected by the head protecting cap portion.

The conventional full-face-type helmet having the above structure, however, is not easy to wear and remove from the head of a wearer because the head protecting cap portion is also of a full-face type. According to recent full-face-type helmets, to improve the safety of the helmets and feeling of wearing them during a drive, the lower end portion of the head protecting cap portion is narrowed. In addition, it is heightened more to fit the head and face of the wearer due to blockish inside pads for the cheeks and the like. Owing to this structure, when a helmet wearer, e.g., the rider of a motor cycle, has a traffic accident, e.g., a motor cycle accident, a person who takes care of the rider needs a large force to remove the full-face-type head protecting cap portion from the head of the helmet wearer. For this reasons, it is considerably difficult for one person to remove the helmet from the wearer.

This point will be described below with reference to FIG. 17. This FIG. 17 shows an experiment aimed at measuring the force required to remove a full-face-type helmet 1. A bolt 4 with a ring is attached to the top portion of a full-face-type head protecting cap portion 3 of a conventional full-face-type helmet 1 worn on the head of a helmet wearer 2. The lower end of a spring balancer 5 is coupled to the bolt 4.

In the state shown in FIG. 17 (in which the chin straps (not shown) were unfastened from the chin of the wearer 2), the upper end of the spring balancer 5 was pulled upward. In this case, when a pair of blockish inside pads for the right and left cheeks were attached to the interior of the head protection cap portion 3, the helmet 1 could not be removed until a tension of 16 kg was applied to the top portion of the head protecting cap portion 3. In contrast to this, when the pair of blockish inside pads for the right and left cheeks were detached from the interior of the head protecting cap portion 3, the helmet 1 could be removed by applying only a tension of 2.5 kg to the top portion of the head protecting cap portion 3.

The experiment shown in FIG. 17 revealed that a large force was usually required to remove the full-face-type helmet 1, and that not so large force was required to remove the full-face-type helmet 1 when the blockish inside pads for the cheeks were detached from the interior of the head protecting cap portion 3.

On the basis of the results of the experiment shown in FIG. 17, the present applicant previously proposed the invention disclosed in EP 0 879 566 A2. According to the invention disclosed in EP 0 879 566 A2, when the rider of the motor cycle or the like wears the above-described conventional full-face-type helmet, in order to at least partly pull out the blockish inside pads for the right and left cheeks from the interior of the head protecting cap portion, right and left pull members extruded downward from these blockish inside pads are respectively attached to the blockish inside pads for the right and left cheeks. According to the helmet disclosed in EP 0 879 566 A2, a plurality of male hooks are formed on the blockish inside pads for the right and left cheeks. Also, a plurality of female hooks are formed on the head protection cap portion to be able to recess-projection fit with the plurality of male hooks. The blockish inside pads for the right and left cheeks are attached to the head protection cap portion by recess-projection fitting the plurality of male hooks in the plurality of female hooks.

However, According to the helmet disclosed in EP 0 879 566 A2, prior to removal of the helmet from the head of the helmet wearer having a traffic accident, e.g., a motor cycle accident, a person who takes care of the helmet wearer must:

(a) disengage the plurality of male hooks from the plurality of female hooks directly by hand or by operating an operating member by hand, and (b) at least partially pull out the blockish inside pad for the right and/or left cheek from the head protection cap portion by pulling the pull member.

Since the helmet must be removed from the head of the helmet wearer after performing these two types of preliminary operations described in (a) and (b), the preliminary operations for removing the helmet become cumbersome, and cannot be performed quickly.

SUMMARY OF THE INVENTION

The present invention has been made to solve the drawbacks as described above of the helmet disclosed in EP 0 879 566 A2, and has as its object to provide a helmet that can be removed from the head of a helmet wearer who wears the helmet, with a comparatively simple structure easily and quickly including preliminary operation for removal, and a method of removing the same.

According to the first aspect of the present invention, there is provided a helmet comprising a head protecting cap portion with one or a plurality of blockish inside pads disposed therein, the helmet further comprising one or a plurality of connecting mechanisms to attach at least one of the blockish inside pads to the head protecting cap portion, characterized in that at least one of the connecting mechanisms comprises a recess-projection engaging mechanism including one of an engaging pin and a notched engaging hole disposed on the at least one blockish inside pad side, and a corresponding one of a notched engaging hole and an engaging pin to be disposed on the head protecting cap portion side, when the at least one blockish inside pad is disposed in the head protecting cap portion, the engaging pin is configured to engage with the engaging hole, and when pulling the at least one blockish inside pad outward from inside the head protecting cap portion at least partly, the engaging pin moves forward relatively to outside the engaging hole through a notch of the engaging hole.

According to the second aspect of the present invention, there is provided a method of removing, from a head of a helmet wearer, a helmet comprising a head protecting cap portion with one or a plurality of blockish inside pads disposed therein, at least one of the blockish inside pads being attached to the head protecting cap portion in advance by one or a plurality of connecting mechanisms, characterized by comprising, when attaching the at least one blockish inside pad, using, as at least one of the connecting mechanisms, a recess-projection engaging mechanism including one of an engaging pin and a notched engaging hole disposed on the at least one blockish inside pad side, and a corresponding one of a notched engaging hole and an engaging pin disposed on the head protecting cap portion side to be able to engage with one of the engaging pin and the engaging hole, when removing the helmet worn on the head of the helmet wearer, first, pulling the at least one blockish inside pad outward from inside the head protecting cap portion to cause the engaging pin to relatively come out from the engaging hole through a notch of the engaging hole, thus disengaging the engaging pin from the engaging hole, and pulling the blockish inside pad outward from inside the head protecting cap portion at least partly, and removing the head protecting cap portion from the head of the helmet wearer.

According to the first and second aspects of the present invention, even if the helmet is of a type that cannot be easily detached from the head of the helmet wearer, at least one blockish inside pad can be pulled out from inside the head protecting cap portion at least partly by only pulling the blockish inside pad outward from the head protecting cap portion directly, or indirectly through a pull member or the like, with a comparatively small force. Therefore, despite the comparatively simple structure, the head protecting cap portion can be removed from the head with a comparatively small force, and the operation for removing the helmet, including preliminary operation for it, can be performed easily and quickly.

According to the first and second aspects of the present invention, in the first mode, the at least one blockish inside pad preferably comprises a blockish inside pad for a left cheek and/or a blockish inside pad for a right cheek. According to the first and second aspects of the present invention, in the second mode, preferably, a pull member to pull the at least one blockish inside pad outward from inside the head protecting cap portion at least partly is attached to the at least one blockish inside pad. In this case, the pull member may comprise a substantially semi-loop-shaped fabric cord or a substantially loop-shaped tape-like fabric cord in red or the like. According to the first and second aspects of the present invention, in the first and second modes, the operation of pulling out the blockish inside pad outward from inside the head protecting cap portion at least partly can be performed further easily.

According to the first and second aspects of the present invention, in the third mode, preferably, the helmet further comprises an inclined guide surface which is formed on the notched engaging hole side to be adjacent to the notch of the engaging hole, and the inclined guide surface is configured to allow the engaging pin, which is to come out relatively from the engaging hole through the notch, to suspend from the engaging hole side. According to the first and second aspects of the present invention, in the third mode, the engaging pin can come out relatively from the notched engaging hole through the notch smoothly.

According to the first and second aspects of the present invention, in the fourth mode, the engaging pin may be disposed on the at least one blockish inside pad side, and the engaging hole may be disposed on the head protecting cap portion side. According to the first and second aspects of the present invention, in the fifth mode, preferably, each of the at least one blockish inside pad is attached to the head protecting cap portion by a plurality of the connecting mechanisms, and one of the plurality of connecting mechanisms comprises a recess-projection fitting mechanism capable of serving as a pivot fulcrum about which the blockish inside pad pivots toward the head protecting cap portion side, and each of remaining ones of the connecting mechanisms comprises the recess-projection engaging mechanism. In this case, the number of the plurality of connecting mechanisms may be three, and accordingly the number of recess-projection engaging mechanisms may be two. Also, in this case, the recess-projection fitting mechanism may comprise a round hook including one of a male hook and a female hook disposed on the at least one blockish inside pad side, and a corresponding one of a female hook and a male hook disposed on the head protecting cap portion side, and the male hook may be configured to detachably fit with the female hook by recess-projection fitting. According to the first and second aspects of the present invention, in the fifth mode, all of the plurality of connecting mechanisms need not be disengaged by pulling the blockish inside pads. Therefore, the operation of taking out the blockish inside pads from inside the head protecting cap portion outward at least partly can be performed further easily.

According to the first and second aspects of the present invention, in the sixth mode, preferably, the engaging pin comprises one of a first male hook and a first female hook attached to a corresponding one of the at least one blockish inside pad side and the head protecting cap portion side, and one of a second female hook and a second male hook configured to detachably fit with a corresponding one of the first male hook and the first female hook by recess-projection fitting, and one of the second female hook and the second male hook comprises an engaging shaft portion which engages with the engaging hole. In this case, preferably, one of the second female hook and the second male hook further comprises a removal-preventive head portion which prevents the engaging shaft portion from levitating from the engaging hole and coming out therefrom. Also, in this case, preferably, the engaging pin comprises the first male hook attached to the at least one blockish inside pad side. According to the first and second aspects of the present invention, in the sixth mode, when engaging the engaging pin with the notched engaging hole, first, the engaging shaft portion of the second female hook or second male hook is engaged with the engaging hole side to attach the second female hook or second male hook alone to the engaging hole, and then, the first male hook or first female hook is fitted with the second female hook or second male hook by recess-projection fitting, thereby attaching the entire engaging pin to the engaging hole. Therefore, the engaging pin can be attached to the engaging hole side (and accordingly the blockish inside pad can be attached to the head protecting cap portion) comparatively easily.

According to the first and second aspects of the present invention, in the sixth aspect, the at least one blockish inside pad preferably comprises at least one thick plate-like cushion member and a bag-like member which covers the cushion member like a bag. The bag-like member preferably comprises a bag main body including an opening, through which the cushion member can be loaded and unloaded, in one surface thereof, and a plurality of holding members each of which is formed of a thin plate-like elastic material and covers the opening at least partly. Part of an outer portion of each of the plurality of holding members is preferably attached to the bag main body on part of a peripheral portion of the opening.

At least one second recess-projection engaging mechanism preferably detachably engages the plurality of holding members with each other. The at least one second recess-projection engaging mechanism preferably comprises the first male hook provided to at least one of the plurality of holding members, and a second notched engaging hole formed in at least another one of the plurality of holding members so as to detachably engage with the first male hook. With this arrangement, the blockish inside pad can have a simple structure and relatively high strength, and the cushion member can easily be taken out of and put in the bag-like member of the blockish inside pad. Accordingly, a cushion member with substantially the same or different shape as that of the cushion member taken out of the bag-like member can replace it and be put in the bag-like member, so the old cushion member can be easily replaced with a new one, or the size and shape of the internal space of the head protection cap portion can easily be changed. In addition, the blockish inside pad can be attached to the head protecting cap portion reliably and correctly with a simplified attaching structure.

The above, and other, objects, features and advantages of this invention will become readily apparent from the following detailed description thereof which is to be read in connection with the accompanying drawings.

DETAILED DESCRIPTION OF THE INVENTION

An embodiment in which the present invention is applied to a full-face-type helmet will be described first with reference to drawings in "1. Schematic Composition of Helmet as a Whole", "2. Composition of Blockish Inside Pad for Cheek", "3. Composition of Attaching Portion of Impact-on-the-chin-and-cheek Absorbing Liner" and "4. Helmet Removing Operation".

1. Schematic Composition of Helmet as a Whole

Figure 1:
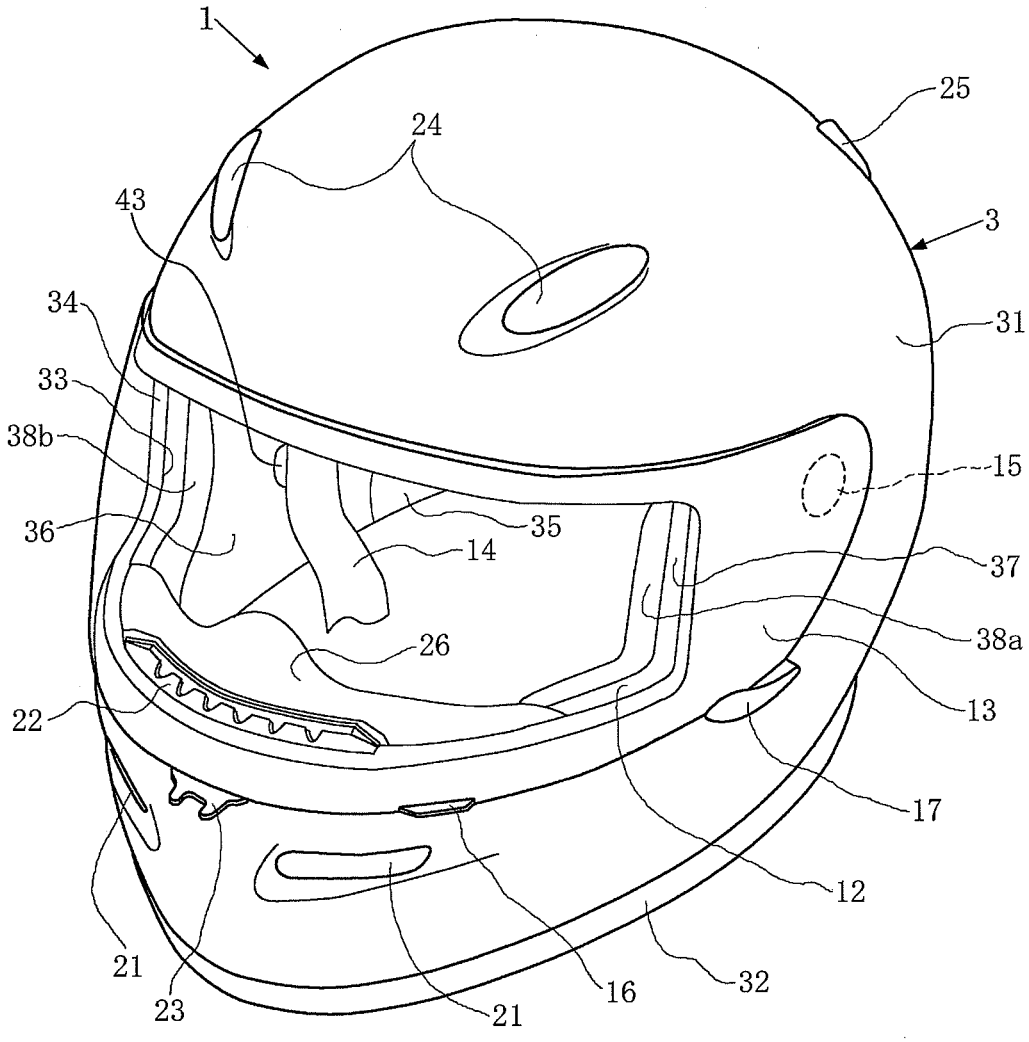
FIG. 1 is an overall perspective view of a helmet in an embodiment in which the present invention is applied to a full-face-type helmet.
Figure 16:
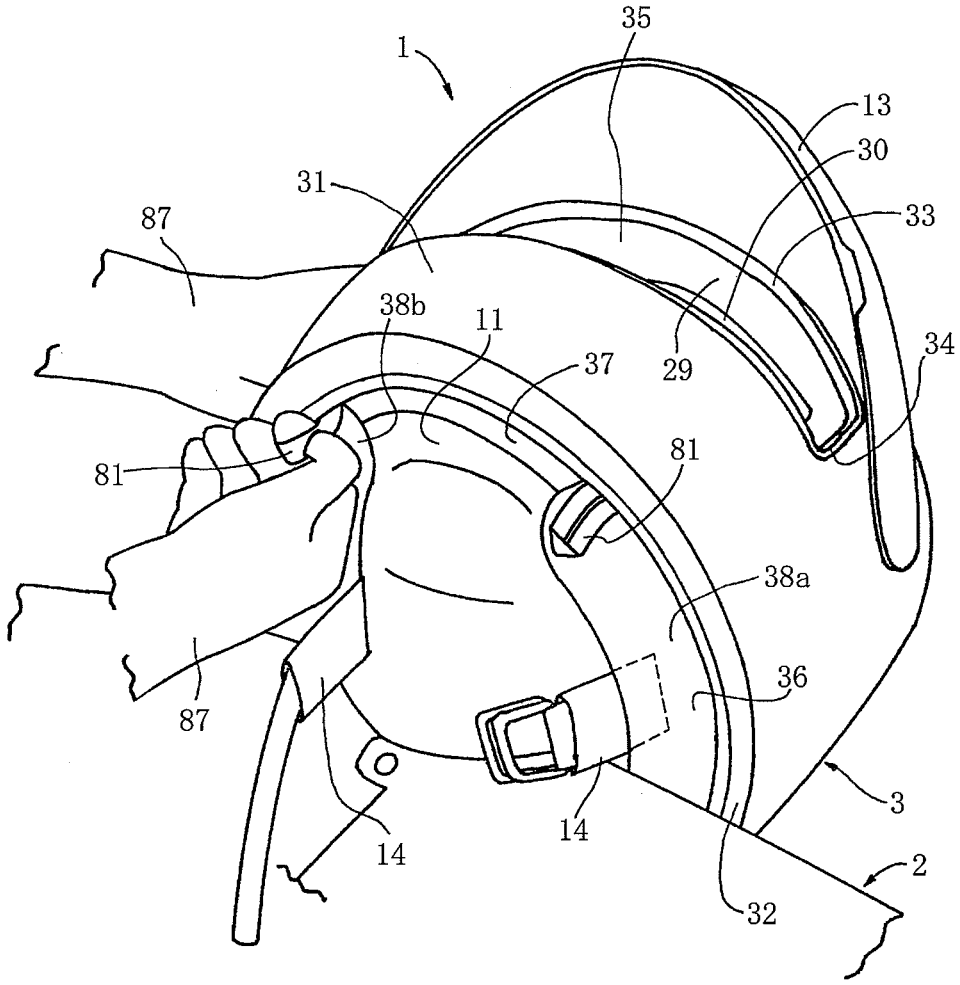
FIG. 16 is a perspective view of the helmet in FIG. 1 in a worn state, in the process of pulling out the blockish inside pads for the cheeks from the impact-on-the-chin-and-cheek absorbing liners.
Figure 17:
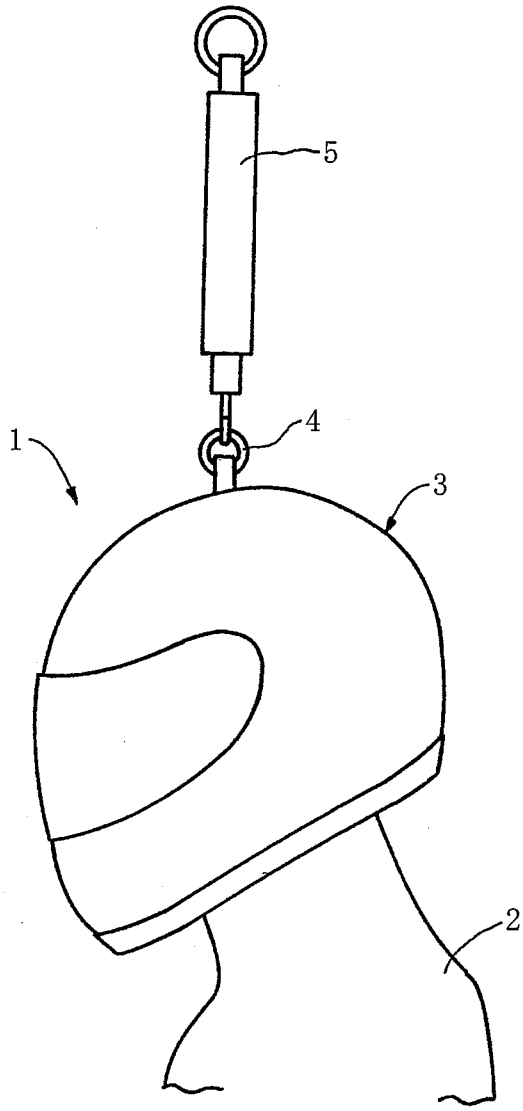
FIG. 17 PRIOR ART
FIG. 17 is a right side view showing an experiment aimed at measuring the force required to remove a conventional full-face-type helmet from the head of a wearer.

As shown in FIGS. 1 and 16, a full-face-type helmet 1 is made up of a full-face-type head protecting cap portion 3, a shield 13 and a pair of right and left chin straps 14. Note that the head protecting cap portion 3 is to be worn on a head 11 of a helmet wearer 2, e.g., the rider of a motor cycle. The shield 13 is capable of opening/closing a window opening 12 formed in the front surface of the head protecting cap portion 3 to oppose the portion (i.e., the center portion of the face) between the forehead and chin of the helmet wearer 2. The chin straps 14 are attached to the interior of the head protecting cap portion 3. As has been known, the shield 13 may be made of a transparent or translucent, hard material such as polycarbonate or another type of hard synthetic resin. The right and left end portions of the shield 13 is pivotally mounted on the head protecting cap portion 3 with a pair of right and left mounting screws 15. The shield 13 closes the window opening 12 at the backward pivoting position shown in FIG. 1, and opens the window opening 12 at the forward pivoting position at which the shield 13 pivots upward from the backward pivoting position. At the intermediate position between these positions, the shield 13 can partly open the window opening 12. In FIG. 1, a tap 16 is formed on the shield 13 to be held by the helmet wearer 2 with his/her fingers when the helmet wearer 2 is to pivot upward and downward the shield 13 forward and backward. An operating lever 17 is formed on the head protection cap portion 3 to be held by the helmet wearer 2 with his/her fingers and operated when the helmet wearer 2 is to slightly pivot upward the shield 13 located at the backward pivoting position.

As is conventionally known, if necessary, the head protection cap portion 3 shown in FIGS. 1 and 16 may incorporate one or a plurality of types of ventilator mechanisms. In FIG. 1, a pair of right and left air supply ports serving also as exhaust ports 21 are formed in the chin region of the head protection cap portion 3 opposing the chin of the helmet wearer 2. An outlet port forming member 22 forms an outlet port through which air introduced from the air supply ports 21 flows upward along the inner surface of the shield 13. An operating tap 23 operates a shutter that opens/closes the outlet port formed by the outlet port forming member 22. A pair of right and left air supply port opening/closing shutters 24 are formed in the front region of the head protection cap portion 3 opposing the front of the head of the helmet wearer 2. A pair of right and left exhaust port opening/closing shutters 25 are formed in the back region of the head protection cap portion 3 opposing the back of the head of the helmet wearer 2. A breath guard 26 is formed near the chin region of the head protection cap portion 3 to be adjacent to the outlet port forming member 22.

As shown in FIGS. 1 and 16, the head protecting cap portion 3 is made up of a full-face-type outer cap shell 31, a lower rim member 32 having a substantially U-shaped cross-section, a rim member 34 for the window opening, which has a substantially E-shaped cross-section, a backing member 35 for the head, and a backing member 36 for the chin and cheeks. Note that the outer cap shell 31 forms the circumferential wall of the head protecting cap portion 3. The lower rim member 32 is fixed to the outer shell 31 throughout the lower end portion of the outer shell 31 with an adhesive or the like. In addition, the rim member 34 is fixed to the outer shell 31 throughout the circumference of a window opening 33 with an adhesive or the like in order to form the window opening 12 of the head protecting cap portion 3. The backing member 35 is fixed to the outer shell 31 with an adhesive or the like in contact with the inner surface of the outer shell 31 in a front head region, a top head region, right and left side head regions, and a back head region respectively corresponding to the front part, top part, right and left parts, and back part of the head of the helmet wearer 2. The backing member 36 is fixed to the outer shell 31 with an adhesive or the like in contact with the inner surface of the outer shell 31 in chin and cheek regions respectively corresponding to the chin and cheeks of the helmet wearer 2. The outer shell 31 can be made of a composite material. More specifically, the outer shell 31 can be formed by lining the inner surface of a strong shell body made of a hard synthetic resin, e.g., FRP, with a flexible sheet such as a porous unwoven fabric. The lower rim member 32 can be made of a soft synthetic resin such as expanded vinyl chloride or synthetic rubber. The rim member 34 can be made of an elastic material with high flexibility such as synthetic rubber.

As shown in FIGS. 1 and 16, the backing member 35 for the head is constituted by an impact-on-the-head absorbing liner 29 and a permeable backing cover 30 for the head. Note that the backing cover 30 is attached to the impact-on-the-head absorbing liner 29 so as to cover substantially the entire inner surface of the impact-on-the-head absorbing liner 29. As shown in FIGS. 1 and 16, the hacking member 36 for the chin and cheeks is constituted by an impact-on-the-chin-and-cheek absorbing liner 37 and a pair of blockish inside pads **38*b* and 38*a* for the right and left cheeks. The inside pads 38*b* and 38*a* are attached to the impact-on-the-chin-and-cheek absorbing liner 37 in contact with the inner surface of the impact-on-the-chin-and-cheek absorbing liner 37 in right and left cheek regions respectively corresponding to the right and left cheeks of the helmet wearer 2**.

Each of the body portions of the impact-on-the-head absorbing liner 29 and the impact-on-the-chin-and-cheek absorbing liner 37 shown in FIGS. 1 and 16 can be made of a material with appropriate rigidity and appropriate plasticity such as expanded polystyrene or another synthetic resin. The body portion of the backing cover 30 for the head can be made by combining a woven fabric and a porous unwoven fabric obtained by laminating a layer with an appropriate shape which consists of an elastic material with high flexibility such as urethane or another synthetic resin, on the surface (i.e., the outer surface) opposing the impact-on-the-head absorbing liner 29, or on both surfaces.

2. Composition of Blockish Inside Pad for Cheek

The right and left blockish inside pads **38*a* and 38*b* for the cheeks are symmetrical to each other. Hence, the blockish inside pad 38*b* for the right cheek will be described in detail with reference to FIGS. 2, 3 and 14, and a detailed description on the blockish inside pad 38*a*** for the left cheek will be omitted according to circumstances.

Figure 2:
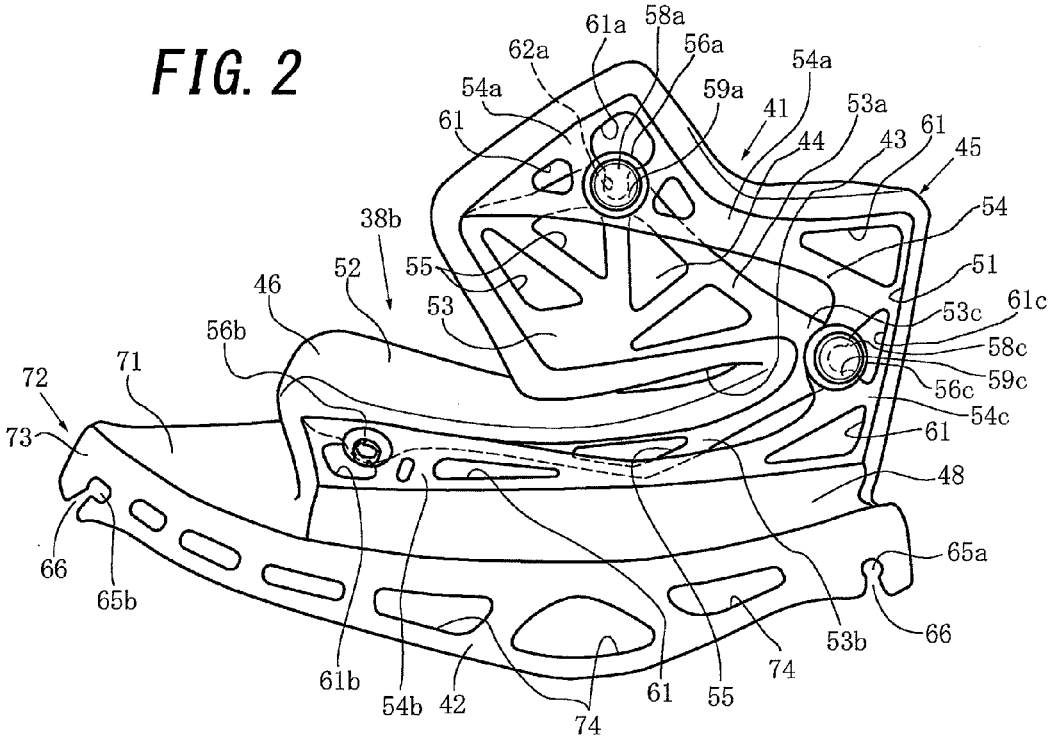
FIG. 2 is a rear view showing a state wherein an engaged member of a blockish inside pad for a right cheek shown in FIG. 1 is expanded downward.
Figure 3:
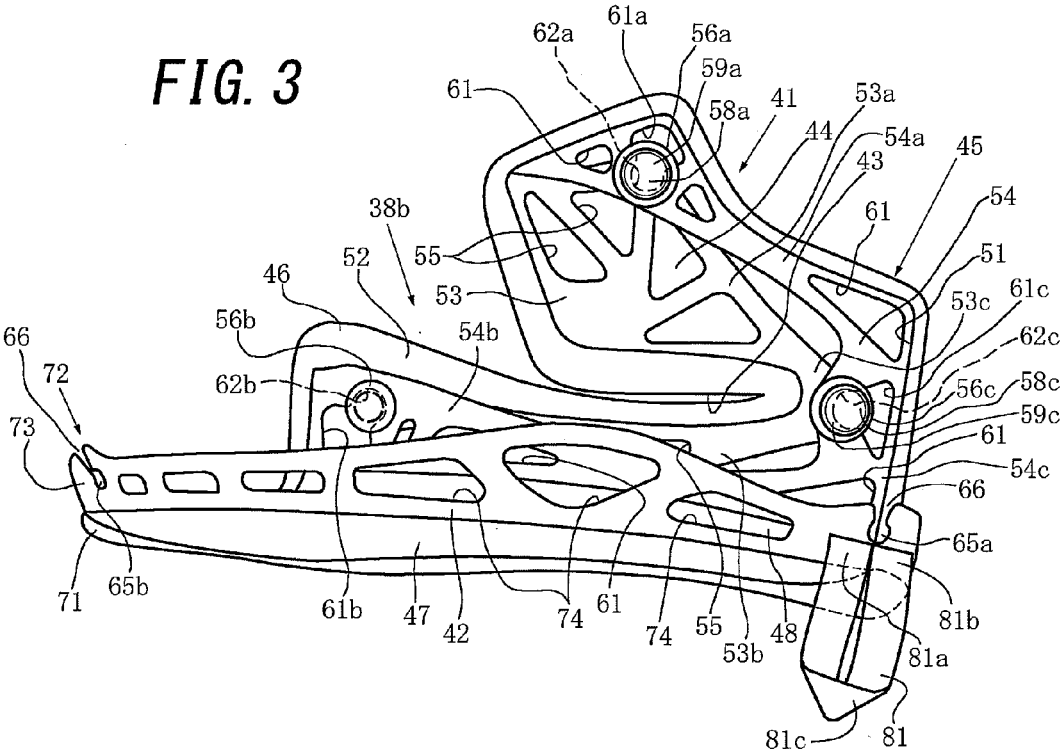
FIG. 3 is a rear view showing a state wherein the blockish inside pad alone for the right cheek shown in FIG. 1 is attached to an impact-on-the-chin-and-cheek absorbing liner.
Figure 14:
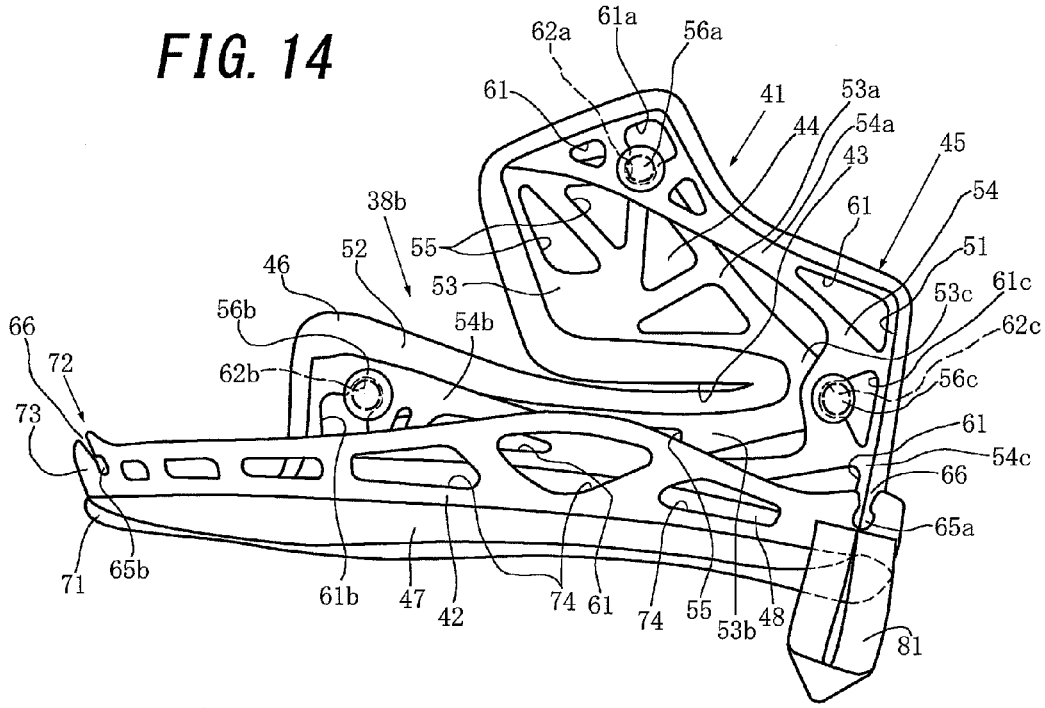
FIG. 14 is a rear view, similar to FIG. 3, showing a state wherein two female hooks are removed from the blockish inside pad for the right cheek shown in FIG. 3.

As shown in FIGS. 2, 3 and 14, the blockish inside pad **38*b* for the right cheek comprises a pad main body 41 and an elongated engaged member 42 which attaches near the lower end of the pad main body 41 throughout substantially its entire length with a sewing thread, a tape, an adhesive or the like. The pad main body 41 has a notch 43 to exclude an ear region corresponding to the right ear of the helmet wearer 2. Accordingly, the pad main body 41 has a shape corresponding to the right cheek and its vicinity (excluding the right ear) of the helmet wearer 2. The pad main body 41 comprises a thick plate-like cushion member 44 which is formed of one or a plurality of highly flexible elastic members such as urethane foam or another synthetic resin, and a bag-like member 45 which covers the cushion member 44 substantially entirely like a bag. Hence, the cushion member 44 is accommodated in and attaches to the bag-like member 45**.

As shown in FIGS. 2, 3 and 14, that surface (i.e., the front surface and, in other words, an inner surface which abuts against the right cheek of the helmet wearer 2) of the bag-like member 45 which is opposite to the surface (i.e., the rear surface) opposing the impact-on-the-chin-and-cheek absorbing liner 37 is substantially entirely formed of a woven fabric portion 46. That one half of the lower surface of the bag-like member 45 which is on the engaged member 42 side is substantially entirely formed of a synthetic leather portion 47 such as vinyl leather. The lower portion of that surface of the bag-like member 45 which opposes the impact-on-the-chin-and-cheek absorbing liner 37 is formed of a porous nonwoven fabric portion 48. The woven fabric portion 46, synthetic leather portion 47 and porous nonwoven fabric portion 48 constitute a bag main body 52 of the bag-like member 45 having an opening 51 which is formed as the upper portion and central portion of that surface of the bag-like member 45 which opposes the impact-on-the-chin-and-cheek absorbing liner 37 continue. The materials of the portions 46, 47 and 48 are not limited to woven fabric, porous or nonporous nonwoven fabric, and synthetic leather, respectively, but can be formed of an arbitrary flexible sheet material including the above materials, a synthetic resin sheet, paper, synthetic resin-laminated paper, and/or natural leather.

A pair of inner and outer holding members 53 and 54, which are formed of thin plate-like elastic materials and vertically laid on each other, partly cover the opening 51 of the bag main body 52 of the bag-like member 45 shown in FIGS. 2, 3 and 14. As shown in FIGS. 2, 3 and 14, each of the inner and outer holding members 53 and 54 may be formed by connecting a large number of substantially band-like portions integrally to form a thin plate-like shape as a whole. Accordingly, each of the inner and outer holding members 53 and 54 may be obtained by punching a sheet material made of a less flexible elastic material, e.g., a soft synthetic resin such as polypropylene or polyethylene, or paper laminated with such a soft synthetic resin, into an appropriate shape. From the viewpoint of practice, generally, the thickness of the sheet material and accordingly of each of the inner and outer holding members 53 and 54 preferably falls within a range of 0.2 mm to 2.5 mm and more preferably within a range of 0.4 mm to 1.8 mm.

As shown in FIGS. 2, 3 and 14, the inner holding member 53 comprises an upper side portion 53*a*, a lower side portion 53*b* and a connecting portion 53*c* which connects the upper and lower side portions 53*a* and 53*b* integrally on the front end side, to form a substantially yoked shape. At the corresponding portions (i.e., part of the outer portion of the inner holding member 53) of the upper side portion 53*a*, the lower side portion 53*b* and the connecting portion 53*c* which are along the notch 43, the inner holding member 53 attaches to part of the outer portion of the opening 51 of the bag main body 52 with a sewing thread, a tape, an adhesive or the like. Each of the upper side portion 53*a*, lower side portion 53*b* and connecting portion 53*c* of the inner holding member 53 has one or a plurality of openings 55. As shown in FIG. 14, male portions (i.e., male hooks serving as engaging projections or fitting projections) 56*a*, 56*b* and 56*c* of round hooks (see FIGS. 2 and 3) attach to portions in the vicinities of the rear ends of the upper and lower side portions 53*a* and 53*b*, and the connecting portion 53*c* by fixing with rivets 57 (see FIGS. 9-13) or the like. Referring to FIGS. 2 and 3, female portions (that is, female hooks) 58*a* and 58*c* of the round hooks detachably fit on the male hooks 56*a* and 56*c* in FIG. 3 by recess-projection fitting. Hence, the male hook 56*a* and female hook 58*a*, and the male hook 56*c* and female hook 58*c* respectively constitute round hooks 59*a* and 59*c* serving as recess-projection fitting mechanisms. The round hooks 59*a* and 59*c* respectively serve as locking pins.

Figure 10:
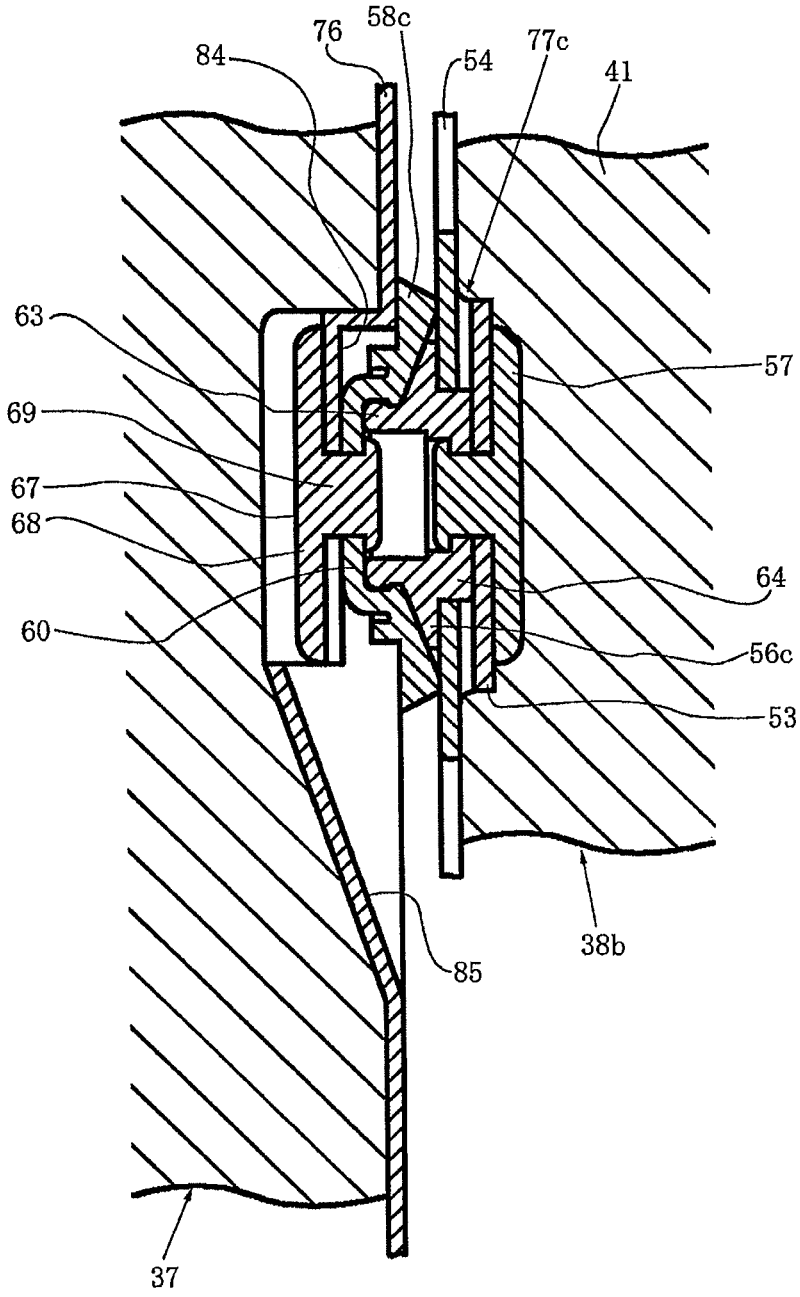
FIG. 10 is a sectional view, similar to FIG. 9, in which a round hook is also shown in the longitudinal section.
Figure 11:
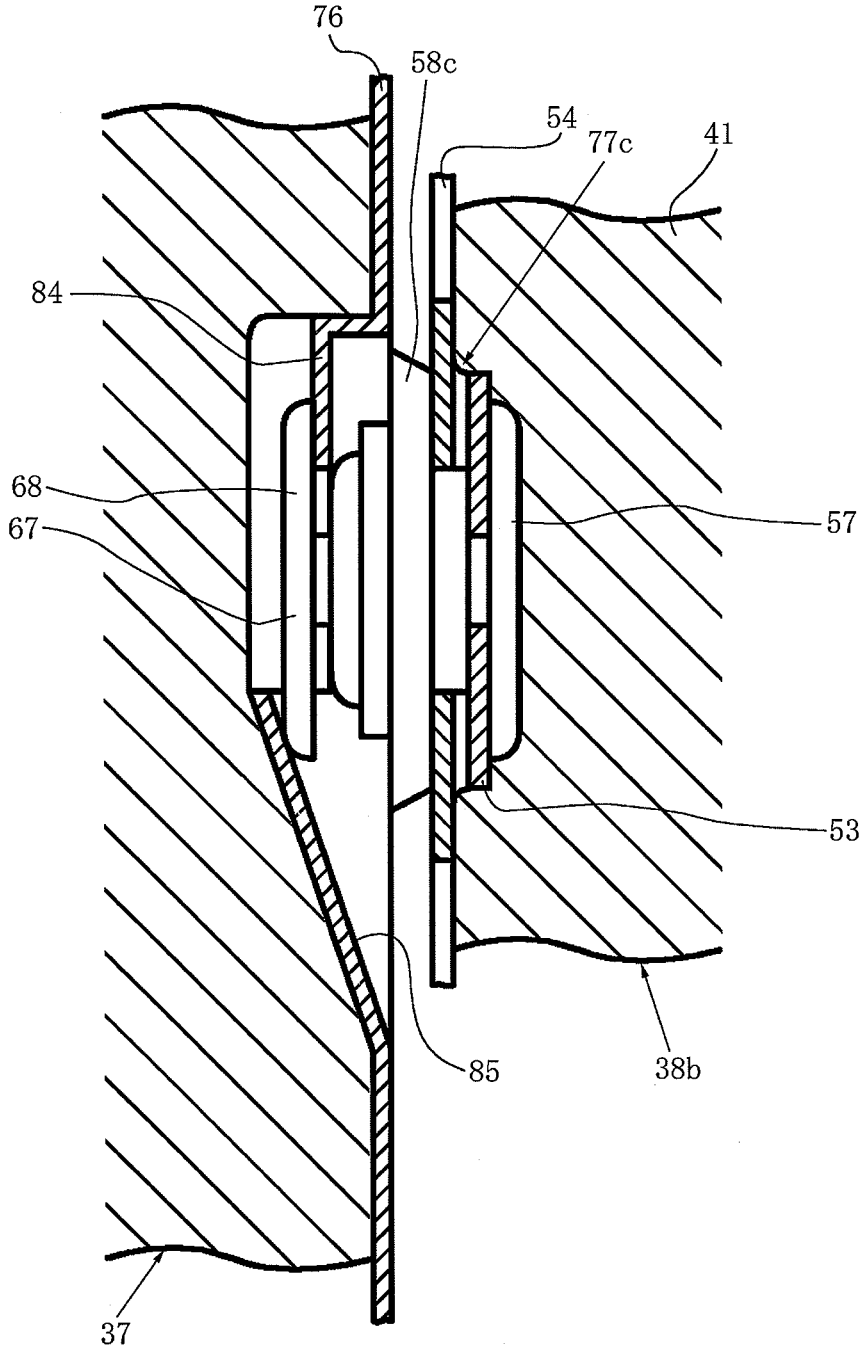
FIG. 11 is a sectional view, similar to FIG. 9, of the round hook in the first state during the process of pulling out the blockish inside pad for the right cheek shown in FIG. 5 from the attaching portion shown in FIG. 4.
Figure 12:
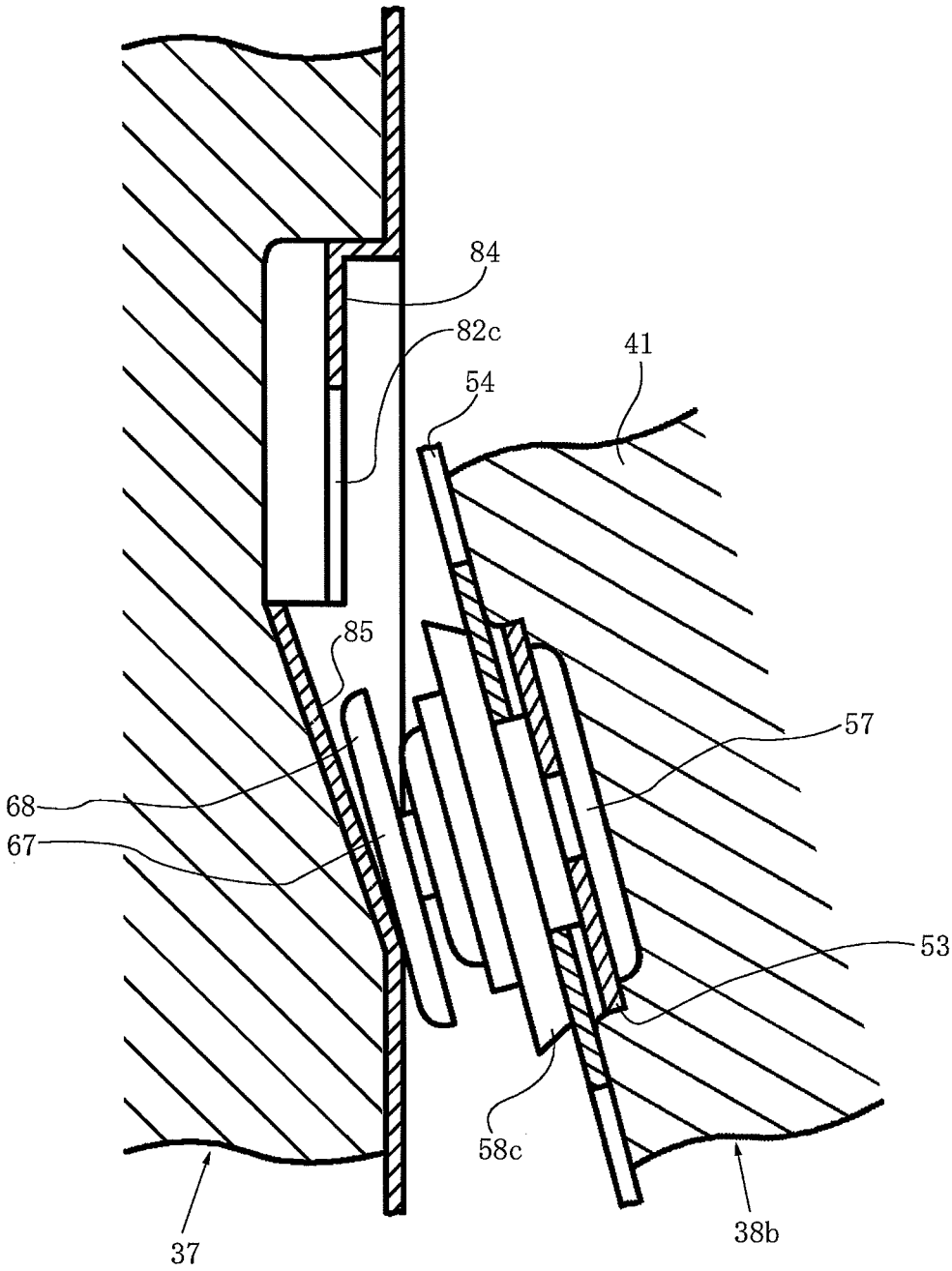
FIG. 12 is a sectional view, similar to FIG. 9, of the round hook in the second state during the process of pulling out the blockish inside pad for the right cheek shown in FIG. 5 from the attaching portion shown in FIG. 4.
Figure 13:
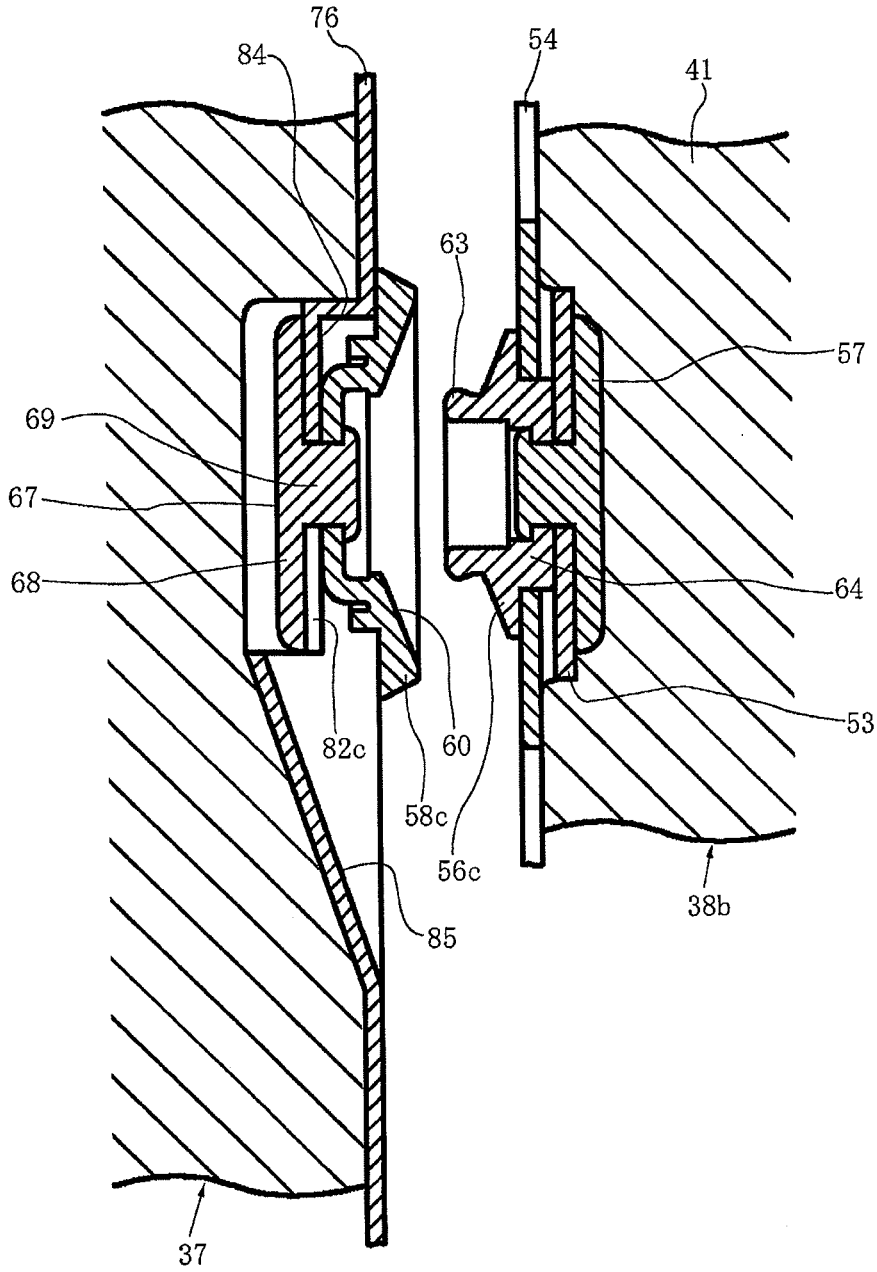
FIG. 13 is a sectional view, similar to FIG. 10, showing a state immediately before fitting the male hook of the blockish inside pad for the right cheek with the female hook of the attaching portion, during the process of attaching the blockish inside pad for the right cheek shown in FIG. 5 to the attaching portion shown in FIG. 4.

Each of the female hook 58*a*, a female hook 58*b* and the female hook 58*c* serving as fitting holes in which the male hooks 56*a*, 56*b* and 56*c* are to fit comprises a hook main body 60, and a rivet-shaped portion 67 connected to the upper portion of the hook main body 60, as shown in, e.g., FIG. 10. Accordingly, an engaging shaft portion 69 formed of a rivet-shaft-shaped portion is formed between a rivet-head-shaped portion 68 of each rivet-shaped portion 67 and the corresponding hook main body 60. The mutual positional relationship between the hook main body 60 and rivet-shaped portion 67 in each of the female hooks 58*a*, 58*b* and 58*c* may be substantially the same as the mutual positional relationship between each of the male hooks 56*a*, 56*b* and 56*c* and the corresponding rivet 57.

As shown in FIGS. 2, 3 and 14, the outer holding member 54 comprises an upper side portion 54*a*, a lower side portion 54*b* and a connecting portion 54*c* which connects the upper and lower side portions 54*a* and 54*b* integrally on the front end side, to form a substantially yoked shape. At the corresponding portions (i.e., part of the outer portion of the outer holding member 54) of the upper side portion 54*a*, the lower side portion 54*b* and the connecting portion 54*c* which are other than the lower end of the upper side portion 54*a*, the upper end of the lower side portion 54*b* and the rear end of the connecting portions 54*c*, the outer holding member 54 attaches to the outer portion of the opening 51 of the bag main body 52 with a sewing thread, a tape, an adhesive or the like. Each of the upper side portion 54*a*, lower side portion 54*b* and connecting portion 54*c* of the outer holding member 54 has a plurality of openings 61. The upper side portion 54*a* has, around an opening 61*a* in the vicinity of its rear end, a notched engaging hole 62*a* corresponding to the upper male hook 56*a* to continue to the opening 61*a*. The lower side portion 54*b* has, around an opening 61*b* in the vicinity of its rear end, a notched engaging hole 62*b* corresponding to the lower male hook 56*b* to continue to the opening 61*b*. The connecting portion 54*c* has, around an opening 61*c*, a notched engaging hole 62*c* corresponding to the front male hook 56*c* to continue to the opening 61*c*.

As shown in FIG. 14, bases 64 of annular male portions 63 (see FIGS. 9-13) of the male hooks 56*a*, 56*b* and 56*c* respectively, detachably fix in the engaging holes 62*a*, 62*b* and 62*c* by fitting. This couples the inner holding member 53 and outer holding member 54 to each other by detachable recess-projection engagement of the engaging projections comprising the annular male portions 63 of the male hooks 56*a*, 56*b* and 56*c* with the engaging holes 62*a*, 62*b* and 62*c*. When fixing the male hooks 56*a*, 56*b* and 56*c* in the engaging holes 62*a*, 62*b* and 62*c* by fitting, after inserting the male hooks 56*a* to 56*c* in the openings 61*a* to 61*c*, the inner holding member 53 is moved relative to the engaging holes 62*a* to 62*c* respectively in substantially a planar direction. This can press-fit the bases (i.e., narrow portions) 64 of the annular male portions 63 of the male hooks 56*a* to 56*c* respectively in the engaging holes 62*a* to 62*c* very easily to engage and fix them.

As shown in FIGS. 2, 3 and 14, the engaged member 42 has a pair of front and rear notches 65*a* and 65*b* in the vicinities of its front and rear ends. When the blockish inside pad 38*b* for the right cheek attaches to the impact-on-the-chin-and-cheek absorbing liner 37 (i.e., the state shown in FIGS. 3 and 4), the pair of notches 65*a* and 65*b* extend upward or obliquely upward to respectively continue to portions around the engaged member 42 through narrow portions 66 respectively formed at the inlets of the pair of notches 62*a* and 62*b*. The rear end of the engaged member 42, together with the bag main body 52, projects more backward than the cushion member 44 of the pad main body 41 to form a backward projection 73 to constitute an inserting portion 72 together with a backward projection 71 of the bag main body 52. The engaged member 42 has a plurality of openings 74 in its longitudinal direction to impart flexibility and reduce the weight. The engaged member 42 can be made of a soft synthetic resin or the like such as polyethylene.

As shown in FIG. 3, 5 to 8, 14 and 16, a pair of left and right pad-pull members 81 are attached near the front ends of the engaged members 42 of the blockish inside pads 38*a* and 38*b* for the left and right cheeks by sewing or adhesion, respectively, and are used to remove the blockish inside pads 38*a* and 38*b* for the left and right cheeks outward from inside the full-face-type head protecting cap portion 3 at least partly. In the embodiment shown in the drawings, two ends 81*a* and 81*b* of a comparatively thin tape-like fabric cord of each pull member 81 are arranged substantially horizontally with hardly any gap between them and are sewn to be substantially parallel in the vertical direction. Thus, the pad-pull members 81 are attached to those surfaces of the engaged members 42 of the inside pads 38*a* and 38*b* which are on the side of the impact-on-the-chin-and-cheek absorbing liner 37. For this purpose, each pull member 81 has a plastic semi-loop shape which is bent substantially at 90° near its front lower end 81*c* and then bent substantially at 90° in the opposite direction near its rear lower end, so that as a whole each pull member 81 forms substantially an U shape the width of which is extremely narrow in the lateral direction.

Therefore, the pair of left and right pull members 81 are arranged near the lower ends and front ends of the outer surfaces of the blockish inside pads 38*a* and 38*b* for the left and right cheeks in a slightly slack state. The pull members 81 accordingly project downward from the lower end faces (that is, the lower ends) of the inside pads 38*a* and 38*b* and hang downward slightly from the lower end faces of the inside pads 38*a* and 38*b*. When the helmet wearer 2 wears the helmet 1, the pull members 81 are hardly seen from the outside. Each pull member 81 is combined with the corresponding engaged member 42 to form a loop-shaped portion that can catch a human finger. A portion near the lower end of either one of the pair of left and right pull members 81, or portions near the lower ends of both the pull members 81, can be preliminarily fixed to the lower end face (in other words, the lower end) of the pad main body 41 or the like of the blockish inside pad 38*a* for the cheek, as in the case of the right pull member 81 shown in FIG. 16. This preliminary fixing may be effected by a small double-sided pressure-sensitive tape or small double-sided adhesive tape, a small Hook-and-Loop faster (e.g., a magic tape (registered tradename)), or tacking with one or plural threads, so that it can be disengaged at once in an emergency.

As shown in FIG. 3 and the like, the pull members 81 are preferably attached to the lower ends of the inside pads 38*a* and 38*b* or near them. The pull members 81, however, need not always be attached to the engaged members 42, but may be attached to members other than the engaged members 42 which are attached to the pad main bodies 41 of the inside pads 38*a* and 38*b*, or may be fixed to the pad main bodies 41 of the inside pads 38*a* and 38*b* directly. The pull members 81 preferably have a color (e.g., red) obviously different from the surface colors of other surrounding members (that is, the pad main bodies 41 of the inside pads 38*a* and 38*b*, the engaged members 42, the impact-on-the-head absorbing liner 29 and the like), so that when started to pull the pull members 81, their positions can be clearly identified. The two ends 81*a* and 81*b* of the fabric cord that constitutes each pull member 81 may be arranged at an appropriate gap between them in, e.g., a substantially horizontal direction so that they form a substantially flat U shape as a whole. The pull member 81 may be arranged by bending the fabric cord into halves and overlaying its two ends 81*a* and 81*b* so as to form a substantially loop shape. The pull member 81 need not always be a tape but may be a plastic rod or thread. In this case, the thickness (that is, the diameter) of the pull member 81 is preferably 0.5 mm to 6 mm and more preferably 2 mm to 4 mm. In this case, only a portion near the distal end of the pad-pull member 81 may form substantially a loop so that it can catch a human finger. In this case, in place of making the portion near the distal end of the pull member 81 substantially into a loop, a flexible finger catching stick made of a soft synthetic resin such as polyethylene, or the like may be attached to the lower end of the pull member 81 or near it to extend in a substantially horizontal direction, so that the pull member 81 forms a substantially inverted-T shape as a whole.

The engaged member 42 of the blockish inside pad 38*b* is inserted in advance between the outer shell 31, and the blockish inside pad 38*b* for the right cheek and impact-on-the-head absorbing liner 29 from below. At this time, the inserting portion 72 of the blockish inside pad 38*b* is also inserted between the outer shell 31 and impact-on-the-head absorbing liner 29 from below. The engaging pins 79 and 80 (see FIG. 5) of the impact absorbing liners 37 and 29 relatively fit in the notches 65*a* and 65*b* of the engaged member 42 from above to recess-projection engage with them. The chin strap 14 inserted through the opening 86 of the impact absorbing liner 37 is relatively inserted in the notch 43 of the inside pad 38*b*. When removing the inside pad 38*b* from the impact absorbing liners 37 and 29, operation opposite to that described above for attaching may be performed.

An example of the operation of taking the cushion member 44 out of the blockish inside pad 38*b* for the right cheek shown in FIGS. 2, 3 and 14 will be described.

Assume that the blockish inside pad 38*b* is alone in the state shown in FIG. 14. First, those portions of the holding member 53 which are in the vicinities of the male hooks 56*a*, 56*b* and 56*c* are moved downward, forward and obliquely downward respectively with respect to the outer holding member 54 to extract the annular male portions 63 of the male hooks 56*a*, 56*b* and 56*c* respectively from the engaging holes 62*a*, 62*b* and 62*c*, and then the inner holding member 53 is brought to above the outer holding member 54. Subsequently, the inner holding member 53 is reversed from the front side to the rear side in FIG. 14 of the cushion member 44 and bag main body 52 with reference to the vicinity of that portion of the pad main body 41 which is around the notch 43 as a reverse line. In the reversal state, the inner holding member 53 is not present on the opening 51, and only the outer holding member 54 is present on the opening 51. Therefore, the cushion member 44 can be taken out of the bag main body 52 very easily while elastically deforming the outer holding member 54 appropriately. When storing the cushion member 44 or another cushion member in the bag main body 52, operation opposite to that described above may be performed.

3. Composition of Attaching Portion of Impact-on-Chin-and-Cheek Absorbing Liner

Figure 5:
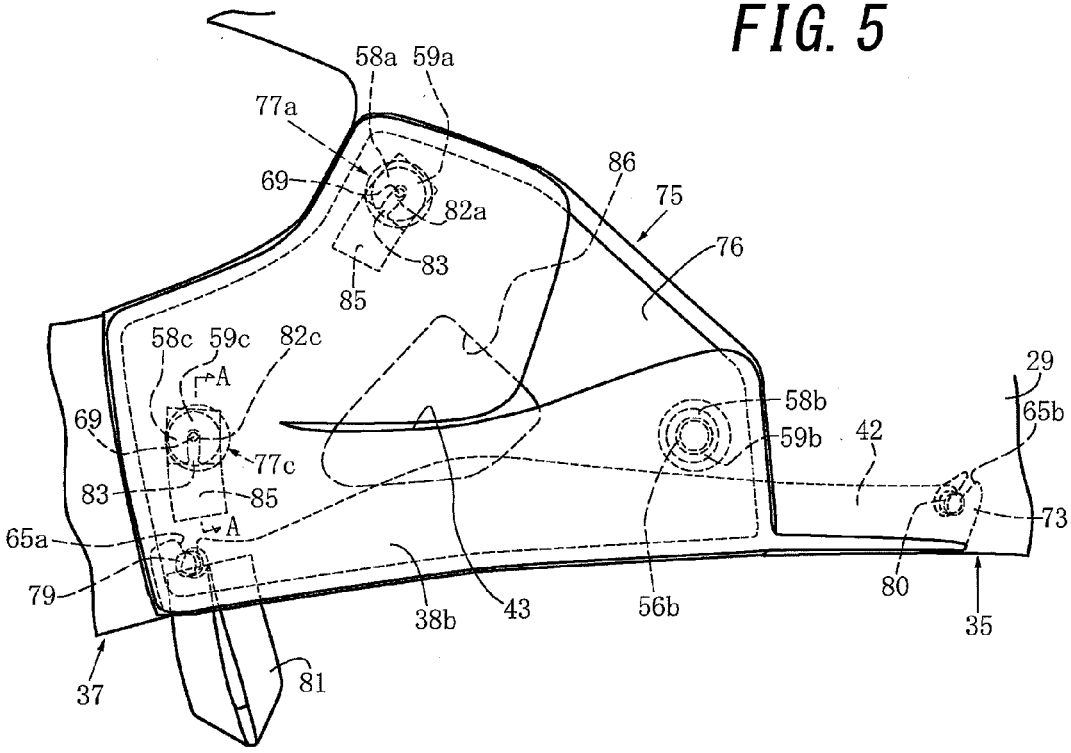
FIG. 5 is a front view showing a state wherein the blockish inside pad for the right cheek in FIG. 1 is attached to the attaching portion shown in FIG. 4.
Figure 9:
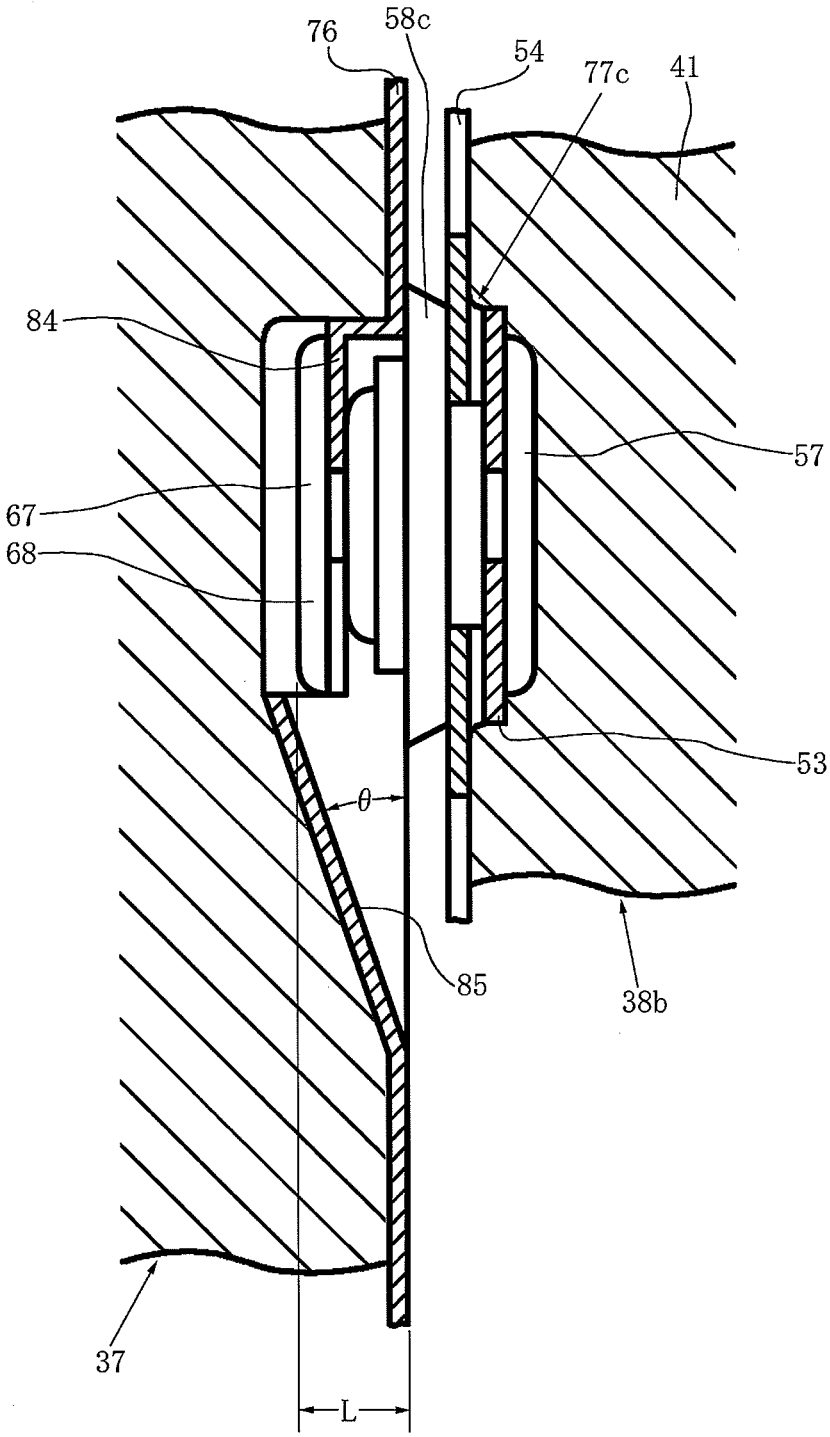
FIG. 9 is a sectional view taken along the line A-A of FIG. 5.

As shown in FIGS. 5, 9 and 10, the blockish inside pads 38*a* and 38*b* for the left and right cheeks are attached substantially in contact with inner surfaces (that is, the right and left attaching portions) 75 of the right half and left half, respectively, of the impact-on-the-chin-and-cheek absorbing liner 37. A pair of left and right thin plate-like support members 76 are attached by adhesion or the like to that surface of the main body portion of the impact-on-the-chin-and-cheek absorbing liner 37 which is on the side (that is, the inner surface) opposite to the outer cap shell 31, so as to constitute the pair of left and right attaching portions 75 to which the inside pads 38*a* and 38*b* are to be attached respectively. The pair of left and right blockish inside pads 38*a* and 38*b* are symmetrical, as described above, and the pair of left and right attaching portions 75 are also symmetrical. Hence, the blockish inside pad 38*b* for the right cheek and the left attaching portion 75 to which it is to be attached will be described hereinafter in detail with reference to FIGS. 5, 9 and 10, and a detailed description on the blockish inside pad 38*a* for the left cheek and the right attaching portion 75 to which it is to be attached will be omitted when appropriate.

Figure 4:
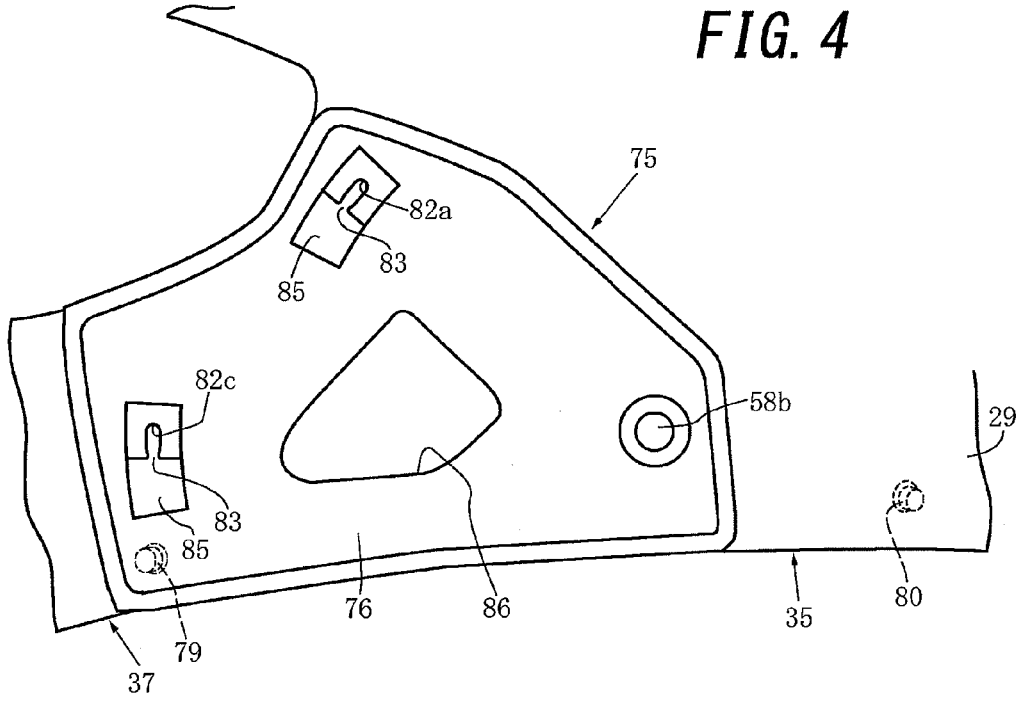
FIG. 4 is a front view of an attaching portion of an impact-on-the-chin-and-cheek absorbing liner to which the blockish inside pad for the right cheek shown in FIG. 3 is to be attached.
Figure 15:
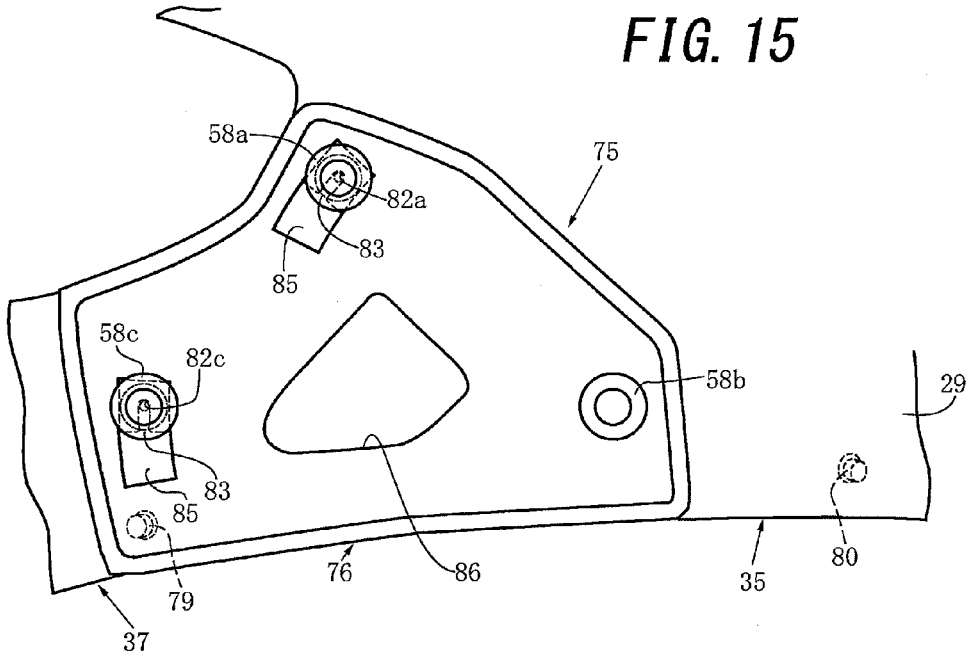
FIG. 15 is a front view, similar to FIG. 4, showing a state wherein two female hooks are attached to the attaching portion shown in FIG. 4.

As shown in FIGS. 4 and 15, the female portion (that is, the female hook) 58*b* of the round hook is formed on the left support member 76 by integral molding with the support member 76, attaching by riveting or the like so as to oppose the male hook 56*b* of the blockish inside pad 38*b* for the right cheek shown in FIG. 3. The female hook 58*b*, together with the male hook 56*b* shown in FIG. 3, constitutes a round hook 59*b* serving as a recess-engagement fitting mechanism. The support member 76 has steps 84, as shown in FIG. 9 and the like. As shown in FIGS. 3 and 9, notched engaging holes 82*a* and 82*c* are formed in the respective steps 84 by, e.g., integral molding with the support member 76 so as to oppose the male hooks 56*a* and 56*c* (in other words, the female hooks 58*a* and 58*c*) of the blockish inside pad 38*b* for the right cheek shown in FIG. 3. The engaging holes 82*a* and 82*c* are continuous to the outside through narrow portions 83 respectively formed at the mouths (in other words, notches) of the engaging holes 82*a* and 82*c*. The notched engaging holes 82*a* and 82*c* extend substantially downward to form an arc having the center of the female hook 58*b* as the center of the circle.

Therefore, when the engaging shaft portions 69 of the female hooks 58*a* and 58*c* of the round hooks 59*a* and 59*c*, which are engaging pins serving also as the recess-projection fitting mechanisms, are pressed into the engaging holes 82*a* and 82*c* through the narrow portions 83 by moving them substantially toward the surface of the support member 76, the female hooks 58*a* and 58*c* can be attached and fixed to the support member 76, as shown in FIGS. 9, 10 and 15. When operation opposite to this is performed, the engaging shaft portions 69 can be pulled out from the engaging holes 82*a* and 83*c* through the narrow portions 83. With the female hooks 58*a* and 58*c* being attached to the support member 76 (and accordingly the attaching portion 75) as shown in FIG. 15, when the male hooks 56*a*, 56*b* and 56*c* of the inside pad 38*b* shown in FIG. 14 are fitted in the female hooks 58*a*, 58*b* and 58*c* of the support member 76 by recess-projection fitting through the state shown in FIG. 13, the inside pad 38*b* can be attached to the support member 76 easily and reliably. In this case, annular projections formed of the distal end portions of the annular male portions 63 of the male hooks 56*a* to 56*c* elastically engage with annular projections formed of the distal end portions of the female hooks 58*a* to 58*c*, respectively. When the male hooks 56*a*, 56*b* and 56*c* are removed from the female hooks 58*a*, 58*b* and 58*c* (in other words, when the recess-projection fitting is canceled), the blockish inside pad 38*b* can be removed from the support member 76 easily and reliably. The round hook 59*a* serving as the engaging pin and the notched engaging hole 82*a* constitute a recess-projection engaging mechanism 77*a*, and the round hook 59*c* serving as the engaging pin and the notched engaging hole 82*c* constitute a recess-projection engaging mechanism 77*c*.

Inclined guide surfaces (in other words, inclined guide plate portions) 85 are formed on the support member 76 substantially under the narrow portions 83 to be adjacent to them, as shown in FIG. 9. When pulling out the female hooks 58*a* and 58*c* from the notched engaging holes 82*a* and 82*c* through the narrow portions 83, the respective inclined guide surfaces 85 guide the female hooks 58*a* and 58*c* by sliding. Each guide plate portion 85 can be formed by inclining one portion (more specifically, a portion substantially under the narrow portion 83) of the support member 76, e.g., a substantially rectangular portion, toward the impact-on-the-chin-and-cheek absorbing liner 37 substantially upwardly from substantially a lower portion. An angle θ of inclination (see FIG. 9) of the inclined guide surface 85 with respect to the main body portion (in other words, the attaching portion 75) of the support member 76 is about 20" in the embodiment shown in the drawings. Generally from the viewpoint of practicability, an average angle θ of inclination of the inclined guide surface 85 preferably falls within a range of 10" to 30°, and more preferably within a range of 15° to 25°. A distance L (see FIG. 9) by which the round hooks 59*a* and 59*c* (in other words, the female hooks 58*a* and 58*c* serving as the engaging projections of the recess-projection engaging mechanisms) suspend from the impact-on-the-chin-and-cheek absorbing liner 37 due to the presence of the inclined guide surface 85 is about 3.5 mm in the embodiment shown in the drawings. Generally from the viewpoint of practicability, the suspension distance L preferably falls within a range of 1.5 mm to 5.5 mm, and more preferably within a range of 2.5 mm to 4.5 mm.

The main body portion of the impact-on-the-chin-and-cheek absorbing liner 37 may be partly covered in advance with a flexile sheet made of a porous nonwoven fabric or PVC leathercloth. As shown in FIG. 4 or the like, the main body portion may have an opening (not shown) through which the chin strap 14 is to extend. To correspond to this opening, the support member 76 may have an opening 86 substantially at its center. The main body portion of the impact-on-the-chin-and-cheek absorbing liner 37 and the main body portion of the impact-on-the-head absorbing liner 29 may be respectively provided with engaging pins 79 and 80 which respectively oppose the notches 65*a* and 65*b* of the engaged member 42 and engage them relatively.

4. Helmet Removing Operation

In the state shown in FIG. 16 in which the helmet wearer 2 wears the full-face-type helmet 1 shown in FIGS. 1 to 15, a person (e.g., a person who takes care of the rider having a motor cycle accident) other than the helmet wearer 2 can remove the helmet 1 from the head 11 of the helmet wearer 2 in the following steps (1) to (7). The helmet wearer 2 himself can also remove the helmet 1 in accordance with the same steps.

(1) First, the person disengages the pair of right and left chin straps 14 from each other, as shown in FIG. 16.

(2) Second, assume that both (or one) of the pair of left and right pull members 81 are (is) preliminarily attached to the lower end faces (face) of the pad main bodies (body) 41 of the inside pads 38*a* and 38*b* (or inside pad 38*a* or 38*b*) (see the right pull member 81 in FIG. 16). In this case, the person holds at least one pull member 81 with the fingers of his hand 87 to release the preliminarily attached pull member 81, and pulls it outward as indicated by the left pull member 81 in FIG. 16.

Figure 6:
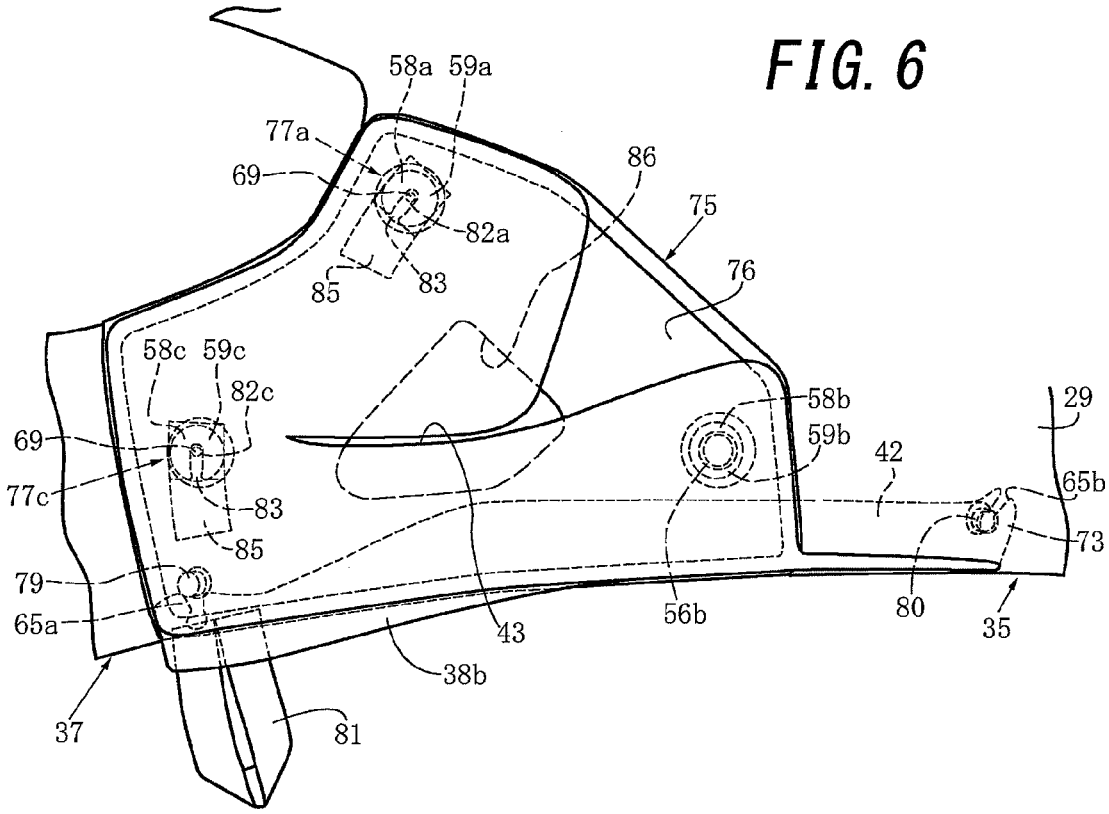
FIG. 6 is a front view, similar to FIG. 5, showing the blockish inside pad for the right cheek in the first state during the process of pulling out the blockish inside pad for the right cheek shown in FIG. 5 from the attaching portion shown in FIG. 4.
Figure 7:
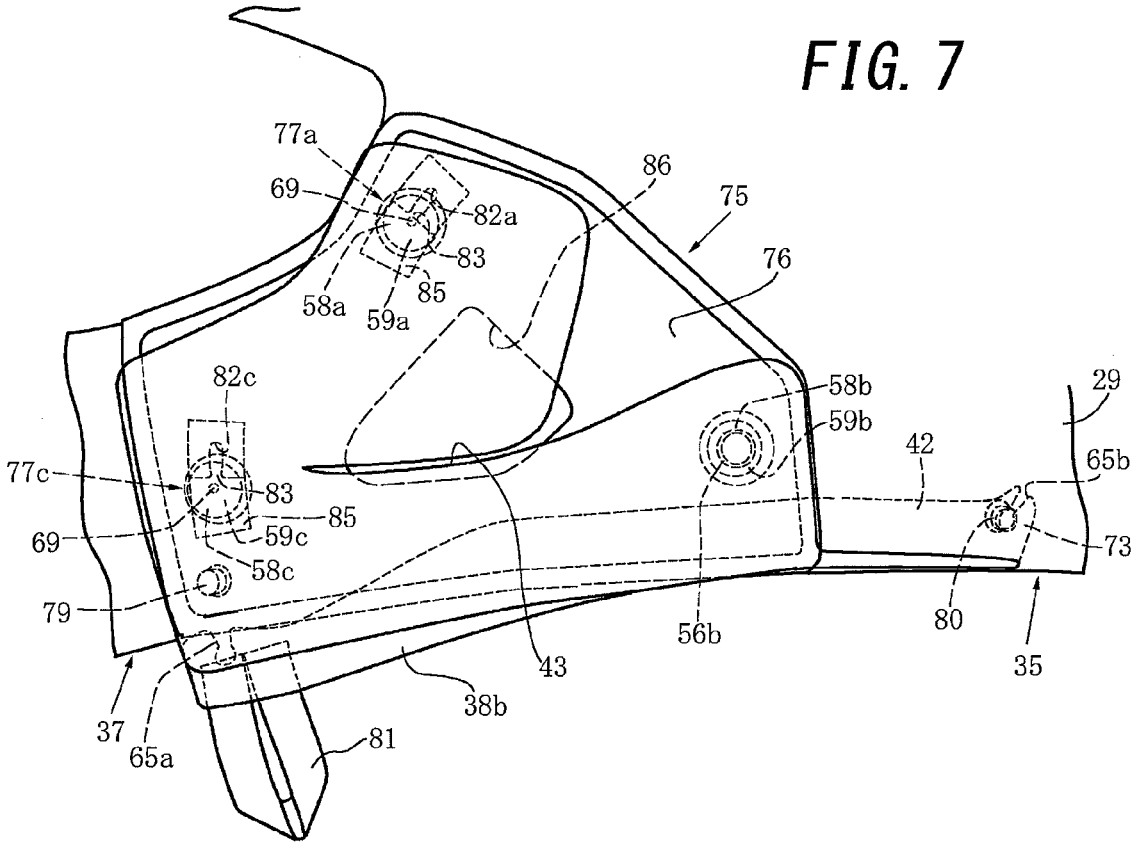
FIG. 7 is a front view, similar to FIG. 5, showing the blockish inside pad for the right cheek in the second state during the process of pulling out the blockish inside pad for the right cheek shown in FIG. 5 from the attaching portion shown in FIG. 4.

(3) The person then slightly pulls the pull members 81, which are pulled out in this manner, substantially downward (i.e., toward the front side in FIG. 16) with his hands 87. This slightly extracts the engaged members 42 of the inside pads 38*a* and 38*b* to substantially below the helmet 1 from between the outer cap shell 31 (more specifically, the lower rim member 32), and the impact-on-the-chin-and-cheek absorbing liners 37 and the impact-on-the-head absorbing liner 29, as shown in FIG. 6. Accordingly, the engaging pins 79 respectively engaging with the notches 65*a* of the engaged members 42 relatively disengage from the notches 65*a*, respectively.

(4) The person continuously pulls the pull members 81 with his hands 87 substantially downward. The blockish inside pads 38*a* and 38*b* for the cheeks shown in FIG. 6 slightly pivot forward counterclockwise in FIG. 6 about the round hooks 59*b* serving as the recess-projection fitting mechanisms as the fulcrums, and reach the state shown in FIG. 7 via the state shown in FIG. 11. In the states shown in FIGS. 11 and 7, the engaging shaft portions 69 of the round hooks 59*a* and 59*c* which are the recess-projection fitting mechanisms serving also as engaging pins move forward in the notched engaging holes 82*a* and 82*c* of the support members 76 toward the narrow portions 83, and come out of the narrow portions 83, so that the rivet-head-shaped portions 68 are guided by the inclined guide surfaces 85.

Figure 8:
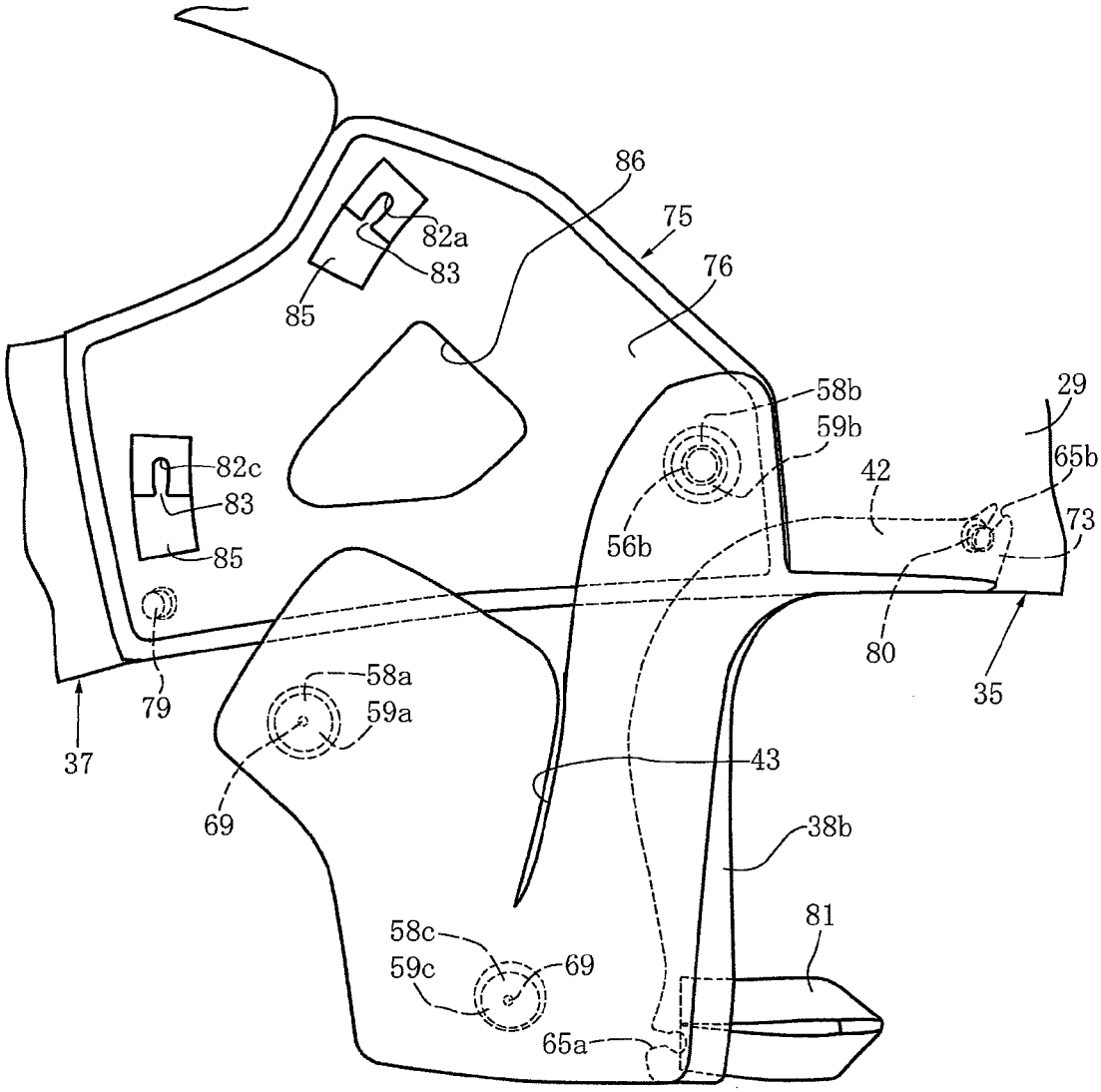
FIG. 8 is a front view, similar to FIG. 5, showing the blockish inside pad for the right cheek shown in FIG. 5 after it is pulled out from the attaching portion shown in FIG. 4.

(5) The person continuously pulls the pull members 81 with his hands 87 substantially downward. The blockish inside pads 38*a* and 38*b* for the cheeks shown in FIG. 7 pivot further forward counterclockwise in FIG. 7 about the round hooks 59*b* as the fulcrums, and reach the state shown in FIG. 8 via the state shown in FIG. 12. In the state shown in FIG. 12, the rivet-head-shaped portions 68 of the engaging shaft portions 69 of the round hooks 59*a* and 59*c* are further guided by the inclined guide surfaces 85. In the state shown FIG. 8, the blockish inside pads 38*a* and 38*b* for the cheeks further pivot forward counterclockwise in FIG. 7 about the round hooks 59*b* as the fulcrums. Thus, the rivet-head-shaped portions 68 move further forward downward from the inclined guide surfaces 85. Therefore, as shown in FIG. 8, most portions (in other words, the front portions and intermediate portions) of the inside pads 38*a* and 38*b* are extracted outward from inside the outer cap shell 31.

(6) Where necessary, the person strongly pulls the inside pads 38*a* and 38*b* or inserts the fingers of his hands 87 into portions between the impact-on-the-chin-and-cheek absorbing liner 37 and inside pads 38*a* and 38*b* to separate the male hooks 56*b* of the round hooks 59*b* from the female hooks 58*b*. The person then completely extracts the inside pads 38*a* and 38*b* from inside the outer shell 31.

(7) The person holds the head protecting cap portion 3 with his hands 87 and separates it from the head 11 of the helmet wearer 2. In this case, at least one of the blockish inside pads 38*a* and 38*b* for the cheeks is no longer in the head protecting cap portion 3 entirely or partly. Hence, the person can easily remove the head protecting cap portion 3 from the head 11 of the helmet wearer 2.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment, the blockish inside pad which is to be extracted at least partly by the pad pull member 81 from inside the head protecting cap portion 3 comprises the blockish inside pads 38*a* and 38*b* for the right and left cheeks. Alternatively, the blockish inside pad to be extracted may comprise an additional blockish inside pad for the forehead, or another existing or additional blockish inside pad.

In the above embodiment, the bag-like member 45 of the pad main body 41 of each of the blockish inside pads 38*a* and 38*b* for the cheeks comprises the pair of inner and outer holding members 53 and 54. However, the bag-like member 45 need not comprise the pair of holding members 53 and 54, and the entire bag-like member 45 may be formed of a flexible sheet member, as has been known. In this case, one or a plurality of hook attaching plates (not shown) to attach the male hooks 56*a* to 56*c* can attach to the bag-like member 45.

In the above embodiment, the three male hooks 56*a* to 56*c* are disposed on each of the blockish inside pads 38*a* and 38*b* for the cheeks. Alternatively, another number of male hooks 56*a* to 56*c* (accordingly the female hooks 58*a*, 58*b* and 58*c*), e.g., two, or four or more, can be disposed on each of the inside pads 38*a* and 38*b*, and etc.

In the above embodiment, the pad-pull members 81 disengage not all (more specifically, three) of the male hooks 56*a* to 56*c* disposed on each of the blockish inside pads 38*a* and 38*b* for the cheeks, but some male hooks (more specifically, two male hooks 56*a* and 56*c*) together with the female hooks 58*a* and 58*c* from the engaging holes 82*a* and 82*c*. The male hooks 56*a* to 56*c* to be disengaged by the pad-pull members 81 may be all of the male hooks 56*a* to 56*c*, or conversely fewer than those of the above case. In this case, the number of engaging holes 82*a* and 82*c* to be formed in each support member 76 can be changed to correspond to the number of male hooks 56*a* to 56*c*. A male hook similar the female hook 58*b* may be attached and fixed to that portion of each support member 76 which corresponds to the eliminated engaging hole.

In the above embodiment, the engaging pins 59*a* and 59*c* are disposed on each of the blockish inside pads 38*a* and 38*b*, and the engaging holes 82*a* and 82*c* are disposed on the head protecting cap portion 3. Inversely, the engaging pins 59*a* and 59*c* may be disposed on the head protecting cap portion 3, and the engaging holes 82*a* and 82*c* may be disposed on each of the blockish inside pads 38*a* and 38*b*. At least one of the plurality of engaging pins 59*a* and 59*c* may be disposed on each of the blockish inside pads 38*a* and 38*b* and at least one of the remaining engaging pins may be disposed on the head protecting cap portion 3, and at least one of the plurality of engaging holes 82*a* and 82*c* may be disposed on the head protecting cap portion 3 and at least one of the remaining engaging hole may be disposed on each of the blockish inside pads 38*a* and 38*b*.

In the above embodiment, the male hooks 56*a* to 56*c* of the round hooks 59*a* to 59*c* are attached and fixed to each of the inside pads 38*a* and 38*b*. Inversely, the mutual positional relationship between the male hooks 56*a* to 56*c* and female hooks 58*a* to 58*c* may be reversed, and the female hooks 58*a* to 58*c* may be attached and fixed to each of the inside pads 38*a* and 38*b*.

In the above embodiment, the pad-pull members 81 to pull out the inside pads 38*a* and 38*b* from inside the head protecting cap portion 3 at least partly are respectively disposed on the blockish inside pads 38*a* and 38*b*. The pull members 81 can be omitted when appropriate. In this case, the person may pull out at least one of the inside pads 38*a* and 38*b* substantially downward by holding its lower end with his hand.

In the above embodiment, each bag-like member 45 stores only one cushion member 44. Alternatively, two or more cushion members 44 may be stacked in a plurality of layers and stored in the bag-like member 45.

In the above embodiment, the engaging projections 56*a* to 56*c* of the recess-projection engaging mechanisms that detachably engage the plurality of holding members 53 and 54 with each other by recess-projection engagement also serve as the fitting projections of recess-projection fitting mechanisms that detachably recess-projection fit the inside pads 38*a* and 38*b* with the head protecting cap portion 3 when incorporating the inside pads 38*a* and 38*b* in the head protecting cap portion 3. Alternatively, the latter fitting projections may be separately provided on the outer holding member 54 or the like. Both of the projection-recess engaging mechanisms and recess-projection fitting mechanisms are not always necessary. In this case, other connecting mechanisms such as taping may replace the former projection-recess engaging mechanisms.

In the above embodiment, when the two holding members 53 and 54 connect to each other by recess-projection engagement, they overlie on each other such that one holding member 53 comes inside and the other holding member 54 comes outside. Alternatively, the two holding members 53 and 54 may overlie on each other such that one holding member 53 is partly inside and partly outside, and the other holding member 54 is partly outside and partly inside.

In the above embodiment, the engaging holes 62*a* to 62*c* are notched engaging holes. Alternatively, the engaging holes 61*a* to 61*c* may be independent engaging holes, e.g., substantially circular holes.

In the above embodiment, each of the holding members 53 and 54 forms a substantially yoked shape, and the holding members 53 and 54 respectively have the plurality of openings 55 and 61 to improve the elasticity and reduce the weight. However, each of the holding members 53 and 54 need not always form a yoked shape, and the openings 55 and 61 can be omitted where necessary.

In the above embodiment, the present invention is applied to the full-face-type helmet 1. The present invention can also be applied to a helmet of another type, e.g., jet type, semi-jet type or the like.

The invention claimed is:

1. A helmet comprising:

(a) a head protecting cap portion comprising an inner surface;

(b) at least one blockish inside pad, wherein said at least one blockish inside pad is configured to be disposed within said head protecting cap portion; and (c) at least one connecting mechanism comprising:

(i) a recess-projection engaging mechanism comprising;

(A) an engaging pin non-slidably and mechanically coupled to either said at least one blockish inside pad or said inner surface; and (B) a channel disposed on the other of said at least one blockish inside pad or said inner surface, the channel comprising;

(I) a notched engaging hole;

(II) a mouth; and (III) a narrow portion, wherein said narrow portion connects said mouth to said notched engaging hole to form said channel, wherein said channel is substantially parallel to said inner surface of said head protecting cap portion when said at least one blockish inside pad is retained within said head protecting cap portion;

wherein said at least one connecting mechanism is configured to removably attach said at least one blockish inside pad to said inner surface of said head protecting cap portion by retaining said engaging pin within said notched engaging hole by moving said engaging pin into said channel at said mouth through said narrow portion to said notched engaging hole, and by directly pulling said at least one blockish inside pad to substantially below the helmet from inside said head protecting cap portion at least partly, said engaging pin exits said channel from said notched engaging hole through said narrow portion and out said mouth simultaneously as the at least one blockish inside pad is directly pulled, thus disengaging said engaging pin from said notched engaging hole, and pulling said at least one blockish inside pad outward from inside said head protecting cap portion at least partly.

2. A helmet according to claim 1, wherein said at least one blockish inside pad comprises any one of a blockish inside pad for a left cheek and a blockish inside pad for a right cheek.

3. A helmet according to claim 1, wherein said at least one blockish inside pad comprises a blockish inside pad for a left cheek and a blockish inside pad for a right cheek.

4. A helmet according to claim 1, wherein a pull member to directly pull said at least one blockish inside pad to substantially below the helmet from inside said head protecting cap portion at least partly is attached to said at least one blockish inside pad.

5. A helmet according to claim 4, wherein said pull member comprises one of a substantially semi-loop-shaped cord and a substantially loop-shaped cord.

6. A helmet according to claim 5, wherein said pull member is red.

7. A helmet according to claim 1, further comprising an inclined guide surface adjacent said notched engaging hole and configured to support said engaging pin after said engaging pin has exited said mouth of the channel.

8. A helmet according to claim 1, wherein said engaging pin is coupled to said at least one blockish inside pad, and said channel is disposed on said inner surface of said head protecting cap portion.

9. A helmet according to claim 1, further comprising a recess-projection fitting mechanism configured to removably attach said at least one blockish inside pad to said head protecting cap portion and serve as a pivot fulcrum about which said at least one blockish inside pad pivots when said at least one blockish inside pad is directly and partially pulled substantially below the helmet from inside said head protecting cap portion.

10. A helmet according to claim 9, wherein said at least one connecting mechanism further comprises two connecting mechanisms.

11. A helmet according to claim 9, wherein said recess-projection fitting mechanism comprises a round hook comprising a female hook and a male hook configured to detachably fit with said female hook by recess-projection fitting.

12. A helmet according to claim 1, wherein said engaging pin comprises at least one hook comprising an engaging shaft portion which engages said notched engaging hole.

13. A helmet according to claim 12, wherein said at least one hook further comprises a removal-preventive head portion which prevents said engaging shaft portion from levitating from and exiting said notched engaging hole.

14. A helmet according to claim 12, wherein said at least one hook comprises a male hook and a female hook, wherein said male hook is attached to said at least one blockish inside pad side.

15. A helmet according to claim 1, wherein said at least one blockish inside pad comprises at least one thick plate-shaped cushion member and a bag-shaped member which covers said thick plate-shaped cushion member, said bag-shaped member comprising a bag main body including an opening, through which said cushion member can be loaded and unloaded, in one surface thereof, and a plurality of holding members each of which is formed of a thin plate-shaped elastic material and partly covers said opening, part of an outer portion of each of said plurality of holding members attached to said bag main body on part of a peripheral portion of said opening, and at least one second recess-projection engaging mechanism is configured to detachably engage said plurality of holding members with each other, said at least one second recess-projection engaging mechanism comprises a male hook provided to at least a first one of said plurality of holding members, and wherein at least a second one of said plurality of holding members comprises a holding member notched engaging hole configured to detachably engage with said male hook.

16. A method of removing, from a head of a helmet wearer, a helmet comprising a head protecting cap portion with one or a plurality of blockish inside pads disposed therein, at least one of the blockish inside pads being attached to the head protecting cap portion in advance by one or a plurality of connecting mechanisms, wherein the method comprises, when attaching the at least one blockish inside pad, using, as at least one of the connecting mechanisms, a recess-projection engaging mechanism including one of an engaging pin and a notched engaging hole disposed on the at least one blockish inside pad side, and a corresponding one of a notched engaging hole and an engaging pin disposed on the head protecting cap portion side to be able to engage with one of the engaging pin and the engaging hole, when removing the helmet worn on the head of the helmet wearer, first, pulling the at least one blockish inside pad outward from inside the head protecting cap portion to cause the engaging pin to relatively come out from the engaging hole through a notch of the engaging hole, thus disengaging the engaging pin from the engaging hole, and pulling the blockish inside pad outward from inside the head protecting cap portion at least partly, and removing the head protecting cap portion from the head of the helmet wearer.

17. A method according to claim 16, wherein said at least one blockish inside pad comprises a blockish inside pad for a left cheek and/or a blockish inside pad for a right cheek.

18. A method according to claim 16, wherein a pull member to pull the at least one blockish inside pad outward from inside the head protecting cap portion at least partly is attached to the at least one blockish inside pad.

19. A method according to claim 16, wherein the method further comprises an inclined guide surface which is formed on the notched engaging hole side to be adjacent to the notch of the engaging hole, and the inclined guide surface being configured to allow the engaging pin, which is to come out relatively from the engaging hole through the notch, to suspend from the engaging hole side.

20. A method according to claim 16, wherein the engaging pin is disposed on the at least one blockish inside pad side, and the engaging hole is disposed on the head protecting cap portion side.

21. A method according to claim 16, wherein each of the at least one blockish inside pad is attached to the head protecting cap portion by a plurality of the connecting mechanisms, and one of the plurality of connecting mechanisms comprises a recess-projection fitting mechanism capable of serving as a pivot fulcrum about which the blockish inside pad pivots toward the head protecting cap portion side, and each of remaining ones of the connecting mechanisms comprises the recess-projection engaging mechanism.

22. A method according to claim 21, wherein the recess-projection fitting mechanism comprises a round hook including one of a male hook and a female hook disposed on the at least one blockish inside pad side, and a corresponding one of a female hook and a male hook disposed on the head protecting cap portion side, and the male hook is configured to detachably fit with the female hook by recess-projection fitting.

23. A method according to claim 16, wherein the engaging pin comprises one of a first male hook and a first female hook attached to a corresponding one of the at least one blockish inside pad side and the head protecting cap portion side, and one of a second female hook and a second male hook configured to detachably fit with a corresponding one of the first male hook and the first female hook by recess-projection fitting, and one of the second female hook and the second male hook comprises an engaging shaft portion which engages with the engaging hole.

24. A method according to claim 23, wherein one of the second female hook and the second male hook further comprises a removal-preventive head portion which prevents the engaging shaft portion from levitating from the engaging hole and coming out therefrom.

25. A method according to claim 23, wherein the engaging pin comprises the first male hook attached to the at least one blockish inside pad side.

26. A helmet comprising:

(a) a head protecting cap portion comprising an inner surface;

(b) at least one blockish inside pad, wherein said at least one blockish inside pad is configured to be disposed within said head protecting cap portion; and (c) a plurality of connecting mechanisms comprising:

(i) a recess-projection engaging mechanism comprising;

(A) an engaging pin non-slidably and mechanically coupled to either said at least one blockish inside pad or said inner surface, said engaging pin comprising a first male hook and a first female hook that form an engaging shaft portion; and (B) a channel disposed on the other of said at least one blockish inside pad or said inner surface, the channel comprising;

(I) a notched engaging hole, wherein said engaging shaft portion engages said notched engaging hole;

(II) a mouth; and (III) a narrow portion, wherein said narrow portion connects said mouth to said notched engaging hole to form said channel, wherein said channel is substantially parallel to said inner surface of said head protecting cap portion when said at least one blockish inside pad is retained within said head protecting cap portion;

wherein at least one of said plurality of connecting mechanisms is configured to removably attach said at least one blockish inside pad to said inner surface of said head protecting cap portion by retaining said engaging pin within said notched engaging hole by moving said engaging pin into said channel at said mouth through said narrow portion to said notched engaging hole, and by directly pulling said at least one blockish inside pad from inside said head protecting cap portion to a position partly below the helmet so that said engaging pin exits said channel from said notched engaging hole through said narrow portion and out said mouth simultaneously as the at least one blockish inside pad is directly pulled, thus disengaging said engaging pin from said notched engaging hole.

27. A helmet according to claim 26, wherein a pull member is attached to said at least one blockish inside pad to directly pull said at least one blockish inside pad outward from inside said head protecting cap portion.

28. A helmet according to claim 26, wherein each of said at least one blockish inside pad is attached to said head protecting cap portion by a plurality of said connecting mechanisms, and one of said plurality of connecting mechanisms comprises a recess-projection fitting mechanism capable of serving as a pivot fulcrum about which said blockish inside pad pivots toward the head protecting cap portion side, and each of remaining ones of said connecting mechanisms comprises said recess-projection engaging mechanism.

29. A helmet according to claim 28, wherein said recess-projection fitting mechanism comprises a round hook including a second male hook and a second female hook, wherein said second male hook is configured to detachably fit with said second female hook by recess-projection fitting.

30. A helmet according to claim 26, wherein one of said first female hook and said first male hook further comprises a removal-preventive head portion which prevents said engaging shaft portion from levitating from said notched engaging hole and coming out therefrom.

31. A helmet according to claim 26, wherein said engaging pin comprises said first male hook attached to said at least one blockish inside pad side.

32. A helmet comprising:

(a) a head protecting cap portion comprising an inner surface;

(b) at least one blockish inside pad, wherein said at least one blockish inside pad is configured to be disposed within said head protecting cap portion; and (c) a plurality of connecting mechanisms comprising:

(i) a recess-projection engaging mechanism comprising;

(A) an engaging pin non-slidably and mechanically coupled to either said at least one blockish inside pad or said inner surface; and (B) a channel disposed on the other of said at least one blockish inside pad or said inner surface, the channel comprising;

(I) a notched engaging hole, wherein said engaging shaft portion engages said notched engaging hole;

(II) a mouth; and (III) a narrow portion, wherein said narrow portion connects said mouth to said notched engaging hole to form said channel, wherein said channel is substantially parallel to said inner surface of said head protecting cap portion when said at least one blockish inside pad is retained within said head protecting cap portion; and (d) an inclined guide surface adjacent said notched engaging, wherein at least one of said plurality of connecting mechanisms is configured to removably attach said at least one blockish inside pad to said inner surface of said head protecting cap portion by retaining said engaging pin within said notched engaging hole by moving said engaging pin into said channel at said mouth through said narrow portion to said notched engaging hole, and by directly pulling said at least one blockish inside pad from inside said head protecting cap portion to a position partly below the helmet so that said engaging pin exits said channel from said notched engaging hole through said narrow portion and out said mouth simultaneously as the at least one blockish inside pad is directly pulled, wherein said inclined guide surface is configured to support said engaging pin after said engaging pin has exited said mouth of the channel thus disengaging said engaging pin from said notched engaging hole.

33. A helmet according to claim 32, wherein said at least one blockish inside pad comprises a blockish inside pad for a left cheek and a blockish inside pad for a right cheek.

34. A helmet according to claim 32, wherein a pull member attached to said at least one blockish inside pad to directly pull said at least one blockish inside pad to substantially below the helmet from inside said head protecting cap portion.

35. A helmet according to claim 32, wherein said engaging pin is coupled to said at least one blockish inside pad, and said channel is disposed on said inner surface of said head protecting cap portion.

36. A helmet according to claim 32, wherein the engaging pin further comprises a male hook and a female hook that form an engaging shaft portion, wherein said engaging shaft portion engages said notched engaging hole.

* * * * *